US008120235B2

(12) United States Patent
Nunome et al.

(10) Patent No.: US 8,120,235 B2
(45) Date of Patent: Feb. 21, 2012

(54) SPARK PLUG FOR INTERNAL COMBUSTION ENGINE AND METHOD FOR MANUFACTURING SPARK PLUG

(75) Inventors: Kenji Nunome, Nagoya (JP); Hiroaki Kuki, Nagoya (JP); Hiroyuki Kameda, Aichi (JP); Kazumasa Yoshida, Nagoya (JP)

(73) Assignee: NGK Spark Plug Co., Ltd., Aichi (JP)

( * ) Notice: Subject to any disclaimer, the term of this patent is extended or adjusted under 35 U.S.C. 154(b) by 0 days.

(21) Appl. No.: 12/741,901

(22) PCT Filed: Nov. 20, 2008

(86) PCT No.: PCT/JP2008/071081

§ 371 (c)(1),
(2), (4) Date: May 7, 2010

(87) PCT Pub. No.: WO2009/066714

PCT Pub. Date: May 28, 2009

(65) Prior Publication Data

US 2010/0264803 A1 Oct. 21, 2010

(30) Foreign Application Priority Data

Nov. 20, 2007 (JP) ..... 2007-300824
Mar. 17, 2008 (JP) ..... 2008-066971

(51) Int. Cl.
*H01T 13/00* (2006.01)

(52) U.S. Cl. ..... 313/141

(58) Field of Classification Search ..... 313/118–145, 313/238; 123/143 R, 146.5 R, 169 R, 169 EL, 123/169 P, 260, 280; 140/174.5; 29/33 M, 29/33 N, 842, 844, 847, 888.01; 445/7
See application file for complete search history.

(56) References Cited

U.S. PATENT DOCUMENTS

| | | | | |
|---|---|---|---|---|
| 4,700,103 | A | 10/1987 | Yamaguchi et al. | |
| 5,488,262 | A | 1/1996 | Takamura | |
| 6,166,480 | A * | 12/2000 | Ishida et al. | 313/141 |
| 6,653,766 | B2 * | 11/2003 | Hori | 313/141 |
| 6,653,767 | B2 * | 11/2003 | Morita et al. | 313/141 |
| 6,720,716 | B2 * | 4/2004 | Shibata et al. | 313/141 |
| 6,724,132 | B2 | 4/2004 | Kanao | |
| 6,731,052 | B2 * | 5/2004 | Moriya | 313/141 |
| 6,798,124 | B2 | 9/2004 | Hiramatsu | |
| 7,084,558 | B2 | 8/2006 | Teramura et al. | |

(Continued)

FOREIGN PATENT DOCUMENTS

EP 0725463 A1 8/1996

(Continued)

*Primary Examiner* — Peter Macchiarolo
(74) *Attorney, Agent, or Firm* — Sughrue Mion, PLLC

(57) ABSTRACT

A spark plug including a center electrode and a ground electrode. A center electrode noble metal tip is joined to a leading end portion of a center electrode, and a ground electrode noble metal tip is joined to a center-electrode-side side surface of the ground electrode. A distal end portion of the ground electrode noble metal tip protrudes from a distal-end surface of the ground electrode by 0.1 mm to 1.5 mm. A center-electrode-side side surface of the ground electrode noble metal tip projects from a center-electrode-side side surface by 0.15 mm to 0.6 mm. The ground electrode includes chamfered portions. Thickness lengths and widthwise lengths of the respective chamfered portions achieved within a cross section perpendicular to a center axis of the ground electrode are set to 0.2 mm or more.

12 Claims, 14 Drawing Sheets

U.S. PATENT DOCUMENTS

| | | | | |
|---|---|---|---|---|
| 7,321,187 | B2 | 1/2008 | Teramura et al. | |
| 7,605,526 | B2 * | 10/2009 | Ishinada et al. | 313/142 |
| 2001/0004183 | A1 * | 6/2001 | Moriya | 313/141 |
| 2002/0021066 | A1 | 2/2002 | Kanao | |
| 2002/0038992 | A1 * | 4/2002 | Morita et al. | 313/141 |
| 2002/0050775 | A1 * | 5/2002 | Hori | 313/141 |
| 2002/0067111 | A1 | 6/2002 | Shibata et al. | |
| 2002/0093277 | A1 | 7/2002 | Hiramatsu | |
| 2003/0038575 | A1 * | 2/2003 | Hori et al. | 313/141 |
| 2003/0071552 | A1 * | 4/2003 | Teramura et al. | 313/143 |
| 2004/0041506 | A1 | 3/2004 | Teramura et al. | |
| 2004/0092193 | A1 * | 5/2004 | Musasa et al. | 445/7 |
| 2006/0238092 | A1 | 10/2006 | Teramura et al. | |
| 2007/0188065 | A1 * | 8/2007 | Ishinada et al. | 313/141 |
| 2009/0134764 | A1 * | 5/2009 | Kameda et al. | 313/141 |
| 2009/0160304 | A1 * | 6/2009 | Kameda et al. | 313/141 |
| 2011/0089807 | A1 * | 4/2011 | Fukuzawa et al. | 313/141 |

FOREIGN PATENT DOCUMENTS

| | | | |
|---|---|---|---|
| EP | 1369969 | A1 | 12/2003 |
| JP | 61-45583 | A | 3/1986 |
| JP | 5-166577 | A | 7/1993 |
| JP | 05-198348 | A | 8/1993 |
| JP | 5-198348 | A | 8/1993 |
| JP | 07-022157 | A | 1/1995 |
| JP | 8-213149 | A | 8/1996 |
| JP | 2002-033176 | A | 1/2002 |
| JP | 2002-83662 | A | 3/2002 |
| JP | 2002-289321 | A | 10/2002 |
| JP | 2002-324650 | A | 11/2002 |
| JP | 2004-127916 | A | 4/2004 |
| JP | 3980279 | B2 | 7/2007 |
| WO | 02/065604 | A1 | 8/2002 |

* cited by examiner

SPARK PLUG FOR INTERNAL COMBUSTION ENGINE AND METHOD FOR MANUFACTURING SPARK PLUG

TECHNICAL FIELD

The present invention relates to a spark plug used in an internal combustion engine as well as to a method for manufacturing a spark plug.

BACKGROUND ART

A spark plug for use in an internal combustion engine, such as an automobile engine, includes, for example, a center electrode extending in an axial direction, an insulator provided outside the center electrode, a cylindrical metal shell provided outside the insulator, and a ground electrode having a base end extending from a leading end of the metal shell. The ground electrode has a rectangular shape in cross section, and an inner side surface of a distal end of the ground electrode is arranged so as to oppose a leading end of the center electrode, whereby a spark discharge gap is formed between the leading end of the center electrode and the distal end of the ground electrode. A conceivable attempt has been made to weld a tip (a noble metal tip) made of a noble metal alloy to the leading end of the center electrode and/or the distal end of the ground electrode, thereby enhancing spark wear resistance.

In order to enhance power and fuel consumption, and realize maintenance-free performance, there exists a demand for a spark plug exhibiting both ignitability and durability. Accordingly, in an attempt to enhance ignitability, there has been proposed a technique for welding a noble metal tip having a comparatively small diameter to a center electrode and welding the noble metal tip to the distal end of the ground electrode while the volume of the distal end of the ground electrode is being comparatively reduced (see; for instance, Patent Document 1 and the like).

Patent Document 1: JP-B-3980279

DISCLOSURE OF THE INVENTION

Problem to be Solved by the Invention

In light of spark discharge occurring between the electrodes of such configurations, spark discharge may occur between the noble metal tip on the center electrode and the ground electrode (a base material) in addition to between the noble metal tips provided on both electrodes. Since the ground electrode is usually inferior to the noble metal tip in terms of spark wear resistance, uneven wear of the ground electrode and, by extension, removal of the ground electrode noble metal tip may also be induced. There is concern that sufficient durability cannot be realized.

If a spark plug is attached with such a positional relationship that a ground electrode exists between a fuel injection device and a spark discharge gap, injected fuel may be sprayed on back of the ground electrode. Namely, the presence of the ground electrode hinders a supply of an air-fuel mixture, which in turn may deteriorate ignitability. For this reason, an effect for enhancing ignitability, which would be yielded by use of the technique, may not be sufficiently acquired.

The present invention was made in consideration of the above circumstance, and an object thereof is to provide a spark plug for use in an internal combustion engine exhibiting sufficient durability and ignitability regardless of an attached state and a method for manufacturing the spark plug for use in an internal combustion engine.

Means for Solving the Problem

Configurations suitable for achieving the objective are described below. An effect specific to a corresponding configuration is added, as necessary.

Configuration 1: A spark plug for an internal combustion engine according to this configuration comprises: a rod-shaped center electrode extending in a direction of an axial line; a substantially-cylindrical insulator provided along an outer periphery of the center electrode; a substantially-cylindrical metal shell provided around an outer periphery of the insulator; a ground electrode arranged to extend from a leading end portion of the metal shell such that a distal end of the ground electrode is bent toward the center electrode; a center electrode noble metal tip joined to a leading end of the center electrode; and a ground electrode noble metal tip joined to a distal end side of a center-electrode-side side surface portion, of side surface portions of the ground electrode, located on a center electrode side, a distal end portion of the ground electrode noble metal tip projecting from a distal end portion of the ground electrode toward the axial line, and a side surface portion on a center electrode side of the ground electrode noble metal tip projecting from the center-electrode-side side surface portion of the ground electrode. Further, a gap is provided between the center electrode noble metal tip and the ground electrode noble metal tip, and the ground electrode noble metal tip is present within an imaginary outer periphery that is an extension of an outer periphery of the center electrode noble metal tip along the direction of the axial line, wherein a tip distal end projection length that is a shortest distance from the distal end portion of the ground electrode to the distal end portion of the ground electrode noble metal tip is 0.5 mm to 1.5 mm, wherein a tip side surface projection length that is a shortest distance from the center-electrode-side side surface portion of the ground electrode to the side surface portion on the center electrode side of the ground electrode noble metal tip is not less than 0.15 mm but not more than 0.6 mm; wherein the ground electrode has a back-side side surface portion situated on back of the center-electrode-side side surface portion, a side surface portion situated between the center-electrode-side side surface portion and the back-side side surface portion. Moreover, one of a chamfered portion and a curved surface portion is formed between adjacent side surface portions of the respective side surface portions, wherein, in a cross section perpendicular to a center axis of the ground electrode, a thicknesswise length of the chamfered portion along a thickness direction of the ground electrode is 0.2 mm or more, and a widthwise length of the chamfered portion along a widthwise direction of the ground electrode is 0.2 mm or more, and a curvature radius of the curved surface portion in the cross section perpendicular to the center axis of the ground electrode is 0.2 mm or more.

According to Configuration 1, a center electrode noble metal tip made of a noble metal alloy is provided for the center electrode, and a ground electrode noble metal tip made of a noble metal alloy is provided for the ground electrode. Therefore, spark wear resistance can be enhanced.

Further, according to Configuration 1, a chamfered portion or a curved surface portion is provided between side surface portions of the ground electrode. An effect of chamfered portions (gap-side chamfered portions) and curved surface portions (gap-side curved surface portions) adjacent to the center-electrode-side side surface portion is first described. As a result of the gap-side chamfered portions or the gap-side curved surface portions being provided, so-called angular portions (edge portions) on which an electric field is likely to concentrate are not formed between the center-electrode-side side surface portion and both side surface portions adjacent to the center-electrode-side side surface portion. Therefore, occurrence of spark discharge between the center electrode noble metal tip and the ground electrode (a base material) can be inhibited, and spark discharge can be made to easily occur between noble metal tips exhibiting comparatively superior durability. Accordingly, it is possible to suppress uneven wear of the ground electrode and also enhance durability.

Since spark discharge can be made to easily occur between the noble metal tips as mentioned above, a location where a flame kernel occurs can be comparatively spaced apart from the ground electrode. A space sufficient for growth of the flame kernel can thereby be assured, and heat dissipation of the flame kernel, which would otherwise be caused by the ground electrode, can be suppressed. As a consequence, accelerating the growth of the flame kernel, and ignitability can be enhanced.

An effect of the chamfered portion (a back-side chamfered portion) and a curved surface portion (a back-side curved surface portion) adjacent to the back-side side surface portion is now described. Even when the spark plug is mounted such that the ground electrode is situated between a fuel injector and a spark discharge gap, a mixed air including injected fuel flows comparatively-smoothly into a gap (a spark discharge gap) between the noble metal tips by passing around the ground electrode because the back-side chamfered portions or the back-side curved surface portions are provided. A decrease in ignitability, which would otherwise be caused by insufficient supply of a mixed air, can more thoroughly be prevented.

Further, according to Configuration 1, the tip distal end projection length is set to 0.5 mm to 1.5 mm. Specifically, the distal end portion of the ground electrode noble metal tip is provided so as to protrude from the distal end portion of the ground electrode toward an axial direction. Accordingly, since the ground electrode can comparatively be separated from the spark discharge gap, a greater space for growth of a flame kernel can be assured. Further, heat dissipation of a flame kernel, which would otherwise be caused by the ground electrode, can be inhibited to a much greater extent. Consequently, ignitability can be enhanced to a much greater extent.

Since the ground electrode noble metal tip is configured so as to protrude from the distal end portion of the ground electrode, the distance between the center electrode noble metal tip and the ground electrode can be comparatively increased, which in turn more thoroughly prevents occurrence of spark discharge between the center electrode noble metal tip and the ground electrode. Therefore, occurrence of uneven wear of the ground electrode can be suppressed to a much greater extent, and durability can be enhanced further.

According to Configuration 1, the tip side surface projection length is set to 0.15 mm to 0.6 mm. Specifically, the center-electrode-side side surface portion of the ground electrode noble metal tip is configured so as to protrude from the center-electrode-side side surface portion of the ground electrode. As a result, spark discharge can be more reliably caused to arise between the noble metal tips, and dissipation of heat of the flame kernel, which would otherwise be caused by the ground electrode, can more reliably be inhibited. As a consequence, ignitability and durability can be further enhanced.

As a result of adoption of Configuration 1, effects yielded by the respective portions act in a synergistic manner, and a significant improvement in ignitability and durability can be attained.

When the tip distal end projection length is less than 0.5 mm, the foregoing effect may not be sufficiently yielded. In the meantime, when the tip distal end projection length exceeds 1.5 mm, the durability may be reduced due to a deterioration of heat dissipation of the ground electrode noble metal tip.

When the tip side surface projection length is less than 0.15 mm, the foregoing effect may not be sufficiently yielded. In the meantime, when the tip side surface projection length exceeds 0.6 mm, the ground electrode becomes too close to the center of the combustion chamber, whereby the ground electrode becomes heated. Therefore, the heat dissipation of the ground electrode noble metal tip may be deteriorated, which in turn may induce deterioration of durability.

In addition, when the thicknesswise length of the chamfered portion achieved in the thicknesswise direction of the ground electrode within the cross section perpendicular to the center axis of the ground electrode is less than 0.2 mm or when the widthwise length of the chamfered portion achieved in the widthwise direction of the ground electrode is less than 0.2 mm, there is a concern that the effects resulting from provision of the chamfered portions being not sufficiently yielded. Moreover, when the curvature radius of the curved portion is less than 0.2 mm in the cross section perpendicular to the center axis of the ground electrode, the aforementioned effect may not be sufficiently yielded.

When the ground electrode noble metal tip is caused to protrude from the distal end portion of the ground electrode, there are conceivable cases where the noble metal tip is caused to protrude in the axial line as described in connection with Configuration 1 and a case where the noble metal tip is caused to protrude toward the center electrode along the direction of the axial line (as described in; for instance, JP-B-3702838 and the like). However, with regard to the latter case, when a sufficiently-large spark discharge gap is provided to accelerate growth of flame kernel, the ground electrode is comparatively-largely project toward the center portion of the combustion chamber. Therefore, the ground electrode becomes liable to a failure, such as thermal fusing. In this regard, the extent to which the ground electrode projects toward the center portion of the combustion chamber can be comparatively reduced by adoption of Configuration 1. Therefore, occurrence of a failure, such as thermal fusing of the ground electrode, can be prevented. Even in this regard, this can be said to contribute to betterment of durability.

Configuration 2: A spark plug for an internal combustion engine of this configuration is the spark plug according to Configuration 1, wherein the tip side surface projection length is 0.3 mm or more.

According to Configuration 2, the tip side surface projection length is 0.3 mm or more. As a result, spark discharge can more reliably be caused to occur between the noble metal tips. Heat dissipation of flame kernel, which would otherwise be caused by the ground electrode, can thoroughly be prevented. Specifically, it is possible to aim at increasing ignitability and durability to a much greater extent by adoption of Configuration 2.

Configuration 3: A spark plug for an internal combustion engine of this configuration is the spark plug according to Configuration 1 or 2, the tip distal end projection length is 1 mm or more.

According to Configuration 3, a tip distal end projection length from the distal end portion of the ground electrode to the distal end portion of the ground electrode noble metal tip is 1 mm or more. Therefore, the ground electrode can be further separated from the spark discharge gap. Accordingly, a space for growth of the flame kernel can further be assured, and heat dissipation of flame kernel, which would otherwise be caused by the ground electrode, can further be prevented. As a result, further enhancement of ignitability can be sought.

In addition, the distance between the center electrode noble metal tip and the ground electrode can further be increased by adoption of Configuration 3, which in turn makes it possible to more reliably prevent occurrence of spark discharge between the center electrode noble metal tip and the ground electrode. As a result, uneven wear of the ground electrode can further be inhibited, and further enhancement of durability can be sought.

Configuration 4: A spark plug for an internal combustion engine of this configuration is the spark plug according to any one of Configuration 1 to 3, wherein a bulge portion containing a same metallic material as that of the ground electrode is formed so as to cover at least a portion, which is located along a direction of the center axis of the ground electrode, of a boundary portion between the ground electrode noble metal tip and the center-electrode-side side surface portion of the ground electrode, wherein an inter-electrode distance that is a shortest distance between the distal end portion of the ground electrode and the imaginary outer periphery is −0.1 mm or more. Further, with reference to the distal end portion of the ground electrode when viewed from a leading-end side in the direction of the axial line, a direction toward a base side of the ground electrode is a negative direction and a direction away from the base side of the ground electrode is a positive direction, and wherein $F \geqq 0.1G$ is satisfied where, in a direction in which the side surface portion on the center electrode side of the ground electrode noble metal tip protrudes with respect to the center-electrode-side side surface portion of the ground electrode, F is a shortest distance between the bulge portion and the side surface portion on the center electrode side of the ground electrode noble metal tip and G is a shortest distance of the gap.

According to Configuration 4, a bulge portion is formed so as to cover at least a portion, which is located along the direction of the center axis of the ground electrode, of the boundary portion between the ground electrode noble metal tip and the center-electrode-side side surface portion of the ground electrode. Therefore, intrusion of oxygen to the boundary portion between the ground electrode noble metal tip and the ground electrode can be prevented, and progress of the oxygen scale, which would otherwise occur in the boundary portion, can more thoroughly be prevented. As a consequence, exfoliation of the ground electrode noble metal tip from the ground electrode can effectively be prevented.

In the meantime, there is concern that spark discharge would arise between the center electrode noble metal tip and the bulge portion as a result of formation of the bulge portion. In this regard, according to Configuration 4, the inter-electrode distance is set to −0.1 mm or more, and the shortest distance F between the bulge portion and the side surface portion on the center electrode side of the ground electrode noble metal tip is comparatively large order of magnitude that is 0.1 times or more the shortest distance G of the gap (the spark discharge gap). As a result, the gap between the center electrode noble metal tip and the bulge portion can be made sufficiently large, whereby occurrence of spark discharge between the center electrode noble metal tip and the bulge portion can effectively be inhibited. Further enhancement of ignitability and durability can consequently be sought.

When the inter-electrode distance is less than −0.1 mm, a distance between the bulge portion and the center electrode noble metal tip cannot be made sufficiently large, and the effects may not be sufficiently yielded.

Configuration 5: A spark plug for an internal combustion engine of this configuration is the spark plug according to any one of Configurations 1 to 4, wherein an inter-electrode distance that is a shortest distance between the distal end portion of the ground electrode and the imaginary outer periphery is +0.1 mm to +0.8 mm where, with reference to the distal end portion of the ground electrode when viewed from a leading-end side in the direction of the axial line, a direction toward a base side of the ground electrode is a negative direction and a direction away from the base side of the ground electrode is a positive direction.

According to Configuration 5, the distance between the center electrode noble metal tip and the ground electrode can be made comparatively large. As a result, a much greater space for spreading the flame kernel can be assured, and further enhancement of ignitability can be sought.

When the inter-electrode distance exceeds +0.8 mm, a reduction in the volume of the ground electrode is unavoidable, which in turn may deteriorate performance for heat dissipation of the ground electrode noble metal tip.

Configuration 6: A spark plug for an internal combustion engine of this configuration is the spark plug according to Configuration 5, wherein a bulge portion containing a same metallic material as that of the ground electrode is formed so as to cover at least a portion, which is located along a direction of the center axis of the ground electrode, of a boundary portion between the ground electrode noble metal tip and the center-electrode-side side surface portion of the ground electrode, and wherein $F \geqq 0.05G$ is satisfied where, in a direction in which the side surface portion on the center electrode side of the ground electrode noble metal tip protrudes with respect to the center-electrode-side side surface portion of the ground electrode, F is a shortest distance between the bulge portion and the side surface portion on the center electrode side of the ground electrode noble metal tip and G is a shortest distance of the gap.

According to Configuration 6, a relationship of $F \geqq 0.05G$ is satisfied, and the shortest distance between the side surface portion on the center electrode side of the ground electrode noble metal tip and the bulge portion can be made comparatively smaller, as compared with Configuration 4. Specifically, the bulge portion can be made to a greater height, and development of the oxidized scale in the boundary portion between the ground electrode noble metal tip and the ground electrode can more thoroughly be prevented. In the meantime, the bulge portion is made closer to the side surface portion on the center electrode side of the ground electrode noble metal tip as a result of the bulge portion being made large, which gives rise to apprehension about occurrence of spark discharge between the bulge portion and the center electrode noble metal tip. However, according to Configuration 6, there is assured a sufficiently-large inter-electrode distance of the order of +0.1 mm or more. Therefore, a sufficient distance between the bulge portion and the center electrode noble metal tip can be assured, and the concern can be eliminated.

Configuration 7: A spark plug for an internal combustion engine of this configuration is the spark plug according to Configuration 5 or 6, wherein a width of a gap-side chamfered portion or a gap-side curved surface portion as the chamfered portion or the curved surface portion which is formed between the center-electrode-side side surface portion and the side surface portion adjacent to the center-electrode-side side surface portion is smaller than a width of a back-side chamfered portion or a back-side curved surface portion as the chamfered portion or the curved surface portion which is formed between the back-side side surface portion and the side surface portion adjacent to the back-side side surface portion.

According to Configuration 7, the width of the gap-side chamfered portion (the gap-side curved surface portion) is smaller than the width of the back-side chamfered portion (the back-side curved surface portion). Accordingly, for instance, when compared with the case where the width of the gap-side chamfered portion (the gap-side curved surface portion) and the width of the back-side chamfered portion (the back-side curved surface portion) are substantially equal to each other, the ground electrode can be made thicker, and enhancement of mechanical strength (durability) of the ground electrode can be sought. As the width of the gap-side chamfered portion (the gap-side curved surface portion) becomes greater, an effect of suppressing occurrence of spark discharge between the ground electrode and the center electrode noble metal tip becomes more superior. Since a sufficiently-large inter-electrode distance of +0.1 mm or more is assured, an effect of suppressing occurrence of spark discharge between the ground electrode and the center electrode noble metal tip is sufficiently yielded even when the width of the gap-side chamfered portion (the gap-side curved surface portion) is made comparatively small.

Configuration 8: A spark plug for an internal combustion engine of this configuration is the spark plug according to any one of Configurations 1 to 7, wherein the ground electrode noble metal tip has a prismatic shape.

By the ground electrode noble metal tip having prismatic as described in relation to Configuration 8, the ground electrode noble metal tip has angular portions where comparatively high field intensity develops. For this reason, spark discharge can be caused to occur more easily between the center electrode noble metal tip and the ground electrode noble metal tip. In other words, since it becomes possible to make spark discharge more difficult to occur between the center electrode noble metal tip and the ground electrode, uneven wear of the ground electrode can more thoroughly be prevented, and further enhancement of durability can be sought.

Configuration 9: A spark plug for an internal combustion engine of this configuration is the spark plug according to any one of Configurations 1 to 8, wherein the ground electrode noble metal tip contains platinum as a main component and also contains one of nickel in an amount of 2 mass % to 30 mass %, iridium in an amount of 3 mass % to 40 mass %, and rhodium in an amount of 3 mass % to 45 mass %.

According to Configuration 9, the ground electrode noble metal tip contains platinum as a main component and also contains any of nickel in an amount of 2 mass % to 30 mass %, iridium in an amount of 3 mass % to 40 mass %, and rhodium in an amount of 3 mass % to 45 mass %. The strength of the ground electrode noble metal tip can further be enhanced, which in turn makes it possible to enhance durability to a much greater extent.

Configuration 10: A spark plug for an internal combustion engine of this configuration is the spark plug according to any one of Configurations 1 to 9, wherein a bulge portion containing a same metallic material as that of the ground electrode is formed so as to cover at least a portion, which is located along a direction of the center axis of the ground electrode, of a boundary portion between the ground electrode noble metal tip and the center-electrode-side side surface portion of the ground electrode, and wherein a height of the bulge portion with reference to the center-electrode-side side surface portion of the ground electrode is 0.1 mm or more.

According to Configuration 10, the bulge portion is made so as to assume a height of 0.1 mm or more. Therefore, development of an oxidized scale in the boundary portion (a junction portion) between the ground electrode noble metal tip and the ground electrode can further be inhibited and, by extension, removal of the ground electrode noble metal tip from the ground electrode can more thoroughly be prevented.

Configuration 11: A spark plug for an internal combustion engine of this configuration is the spark plug according to any one of Configurations 1 to 10, wherein a bulge portion containing a same metallic material as that of the ground electrode is formed so as to cover a boundary portion extending along a direction of the center axis of the ground electrode between the ground electrode noble metal tip and the center-electrode-side side surface portion of the ground electrode, and wherein a shortest distance, along the widthwise direction of the center-electrode-side side surface portion, between the bulge portion and the chamfered portion or the curved surface portion formed between the center-electrode-side side surface portion and the side surface portion adjacent to the center-electrode-side side surface portion is set to 0.2 mm or more.

As mentioned above, providing a bulge portion in order to prevent oxidation of the boundary portion between the ground electrode noble metal tip and a ground electrode is significant. However, if the bulge portion extends to the chamfered portions or the curved surface portions, the aforementioned effects attributable to provision of the chamfered portions, and the like, will not be sufficiently yielded.

In this regard, according to Configuration 11, the shortest distance, along the widthwise direction of the center-electrode-side side surface of the ground electrode, between the chamfered portion or the curved surface portion and the bulge portion is set to 0.2 mm or more. A sufficient distance is provided between the gap-side chamfered portion and the like (the gap-side curved surface portion) and the bulge portion. Specifically, extension of the bulge portion to the gap-side chamfered portion (the gap-side curved surface portion) can more thoroughly be prevented, and the aforementioned effects attributable to provision of the gap-side chamfered portion (the gap-side curved surface portion) are more reliably yielded.

Configuration 12: A method for manufacturing a spark plug of this configuration is a method manufacturing the spark plug for an internal combustion engine according to any one of Configurations 1 to 11, the method comprising: a joining process comprising joining the ground electrode to the ground electrode noble metal tip by resistance welding, wherein a relative Movement regulation means for regulating relative movement of the ground electrode noble metal tip with respect to the ground electrode toward a distal end side of the ground electrode is used in the joining process.

In general, when the ground electrode noble metal tip is joined to the ground electrode by resistance welding, they are joined as follows. Specifically, as shown in FIG. 18, power is applied between the electrodes D1 and D2 while the ground electrode 27 and the ground electrode noble metal tip 32 are sandwiched between a pair of electrodes D1 and D2 for resistance welding, whereby the ground electrode noble metal tip 32 is joined to the ground electrode 27. When the ground electrode and the ground electrode noble metal tip are joined together in such a way that the distal end portion 32*t* of the ground electrode noble metal tip 32 protrudes from the distal end portion 27*t* of the ground electrode 27 as described in connection with Configuration 1 and the like, the ground electrode noble metal tip 32 may move, during joining operation, toward the distal end of the ground electrode 27 (in a direction of an outlined arrow in the drawing).

In this respect, according to Configuration 12, relative movement of the ground electrode noble metal tip toward the distal end of the ground electrode, which would otherwise arise in the joining process, can be prevented by use of the relative movement regulation means. The ground electrode noble metal tip can thereby be joined to an appropriate position on the ground electrode more reliably. As a result, a spark plug that yields the effect as described in connection with Configuration 1 and the like can be manufactured without involvement of much difficulty.

The ground electrode noble metal tip presses the relative movement regulation means during resistance welding, which in turn arouses a concern about collapse of the ground electrode noble metal tip. However, the concern can be eliminated by adoption of Configuration 9. Specifically, on occasion of adoption of the manufacturing method described in connection with Configuration 12, making the ground electrode noble metal tip from the material composition described in connection with Configuration 9 can be said to be more preferable.

BEST MODE FOR CARRYING OUT THE INVENTION

Embodiments are described hereinafter by reference to the drawings. FIG. 1 is a partially-cutaway front view showing a spark plug for use in an internal combustion engine (hereinafter referred to as a "spark plug") 1. In FIG. 1, a direction of an axis CL1 of the spark plug 1 is assumed to be a vertical direction in the drawing, and descriptions are provided on the assumption that a lower side is a leading end of the spark plug 1 and that an upper side is a base end of the same.

The spark plug 1 includes a cylindrical insulator 2 functioning as an insulator, a cylindrical metal shell 3 that holds the insulator, and the like.

As is well known, the insulator 2 is made by sintering alumina, and the like; and includes a base-end-side body portion 10 formed at a base-end side of an outer shape of the insulator, a large-diameter portion 11 formed on a leading-end side of the outer shape with respect to the base-end-side body portion 10 so as to outwardly project in a radial direction, an intermediate body portion 12 formed on the leading-end side of the outer shape with respect to the large-diameter portion 11 so as to become smaller than the same in terms of a diameter, and a leg portion 13 formed on the leading-end side of the outer shape with respect to the intermediate body portion 12 so as to become smaller than the same in terms of a diameter. In the insulator 2, the large-diameter portion 11, the intermediate body portion 12, and the majority of the leg portion 13 are housed in the metal shell 3. A tapered step portion 14 is formed in a connection between the leg portion 13 and the intermediate body portion 12, and the insulator 2 is engagedly fastened to the metal shell 3 by means of the step portion 14.

Further, an axial hole 4 is formed in the insulator 2 in a penetrating fashion along an axis CL1. A center electrode 5 is fixedly inserted to the leading-end side of the axial hole 4. The center electrode 5 as the whole assumes a rod shape (a columnar shape), and a leading-end side thereof protrudes from the leading end of the insulator 2. Moreover, the center electrode 5 includes an inner layer 5A made of copper or a copper alloy and an outer layer 5B made of a Ni alloy containing nickel (Ni) as a main component.

A terminal electrode 6 is fixedly inserted into a base-end side of the axial hole 4 while projecting out of the base end of the insulator 2. A columnar resistor 7 is provided at a position in the axial hole 4 between the center electrode 5 and the terminal electrode 6. Ends of the resistor 7 are electrically connected to the center electrode 5 by way of a conductive glass seal layer 8 and to the terminal electrode 6 by way of a conductive glass seal layer 9, respectively.

In addition, the metal shell 3 is cylindrically made of metal, such as low carbon steel. A thread (an external thread) 15 used for mounting the spark plug 1 to an engine head is formed on an outer periphery of the metal shell. A seat 16 is formed on an outer periphery on the base-end side of the thread 15, and a ring gasket 18 is fitted around a thread neck 17 provided at the base end of the thread 15. Moreover, a tool engagement portion 19, which is used for engagement of a tool, such as a wrench, when the metal shell 3 is fastened to the engine head and which assumes a hexagonal cross-sectional profile, is provided on a base-end side of the metal shell 3. A crimping portion 20 for holding the insulator 2 is provided on the base end portion of the metal shell 3.

A tapered step 21 for fastening the insulator 2 is provided on an internal periphery of the metal shell 3. The insulator 2 is inserted from the base-end side to the leading-end side of the metal shell 3. An opening provided on the base-end side of the metal shell 3 is inwardly crimped in the radial direction while the step 14 of the insulator remains fastened to the step 21 of the metal shell 3; namely, the crimping portion 20 is formed, whereby the insulator 2 is fastened. An annular plate packing 22 is sandwiched between the step 14 of the insulator 2 and the step 21 of the metal shell 3. Air-tightness in a combustion chamber is thereby held, to thus prevent leakage of, to the outside, a fuel air entering a gap between the leg 13 of the insulator 2 exposed to the inside of the combustion chamber and the internal periphery of the metal shell 3.

Further, in order to make more perfect the air-tightness achieved by crimping, annular ring members 23 and 24 are interposed between the metal shell 3 and the insulator 2 on the base-end side of the metal shell 3, and space between the ring members 23 and 24 is filled with powder of talc (french chalk) 25. Specifically, the metal shell 3 holds the insulator 2 by way of the plate packing 22, the ring members 23 and 24, and the talc 25.

A ground electrode 27 made of a Ni alloy, and the like, is joined to a leading end portion (a leading-end face) 26 of the metal shell 3. More specifically, a base end portion of the ground electrode 27 is welded to the leading end portion 26 of the metal shell 3, and a distal-end side of the ground electrode 27 is bent. In addition, the ground electrode 27 has a two-layer structure including an outer layer 27A and an inner layer 27B. In the present embodiment, the outer layer 27A is made of a Ni alloy [e.g., INCONEL 600 or INCONEL 601 (both of which are registered trademarks)]. In the meantime, the inner layer 27B is made of a copper alloy or pure copper that is metal superior to the Ni alloy in terms of thermal conductivity.

In addition, in the present embodiment, a columnar center electrode noble metal tip 31 made of a noble metal alloy [e.g., a platinum (Pt) alloy, an iridium (Ir) alloy, and the like] is welded to a leading-end face of the center electrode 5. More specifically, the center electrode noble metal tip 31 is joined to the center electrode 5 by means of a molten portion 35 that is formed as a result of a metal composition constituting the center electrode 5 and a metal composition constituting the center electrode noble metal tip 31 being melted and mixed together.

A prismatic (rectangular-parallelepiped in the embodiment) ground electrode noble metal tip 32 is joined to the ground electrode 27. More specifically, as shown in FIGS. 2 and 3, the ground electrode noble metal tip 32 is joined to a center-electrode-side side face 27*s*1 located at a position on the ground electrode 27 facing the center electrode 5, by resistance welding, in such a way that a part of one end of the ground electrode noble metal tip 32 is embedded; and also protrude from a distal end portion 27*t* of the ground electrode 27 facing the axial line CL1 toward the axial line CL1 (leftward in the drawing). Moreover, the ground electrode noble metal tip 32 is situated inside of an imaginary outer periphery VG extending from an outer periphery 31*g* of the center electrode noble metal tip 31 along the axial line CL1, whereas the ground electrode 27 is situated outside of the imaginary outer periphery VG. A spark discharge gap 33 as a gap is formed between the leading end portion of the center electrode noble metal tip 31 and a side surface portion facing the center electrode of the ground electrode noble metal tip 32.

In the embodiment, the ground electrode noble metal tip 32 is made of a noble metal alloy (e.g., a Pt-10Ir alloy, or the like) containing Pt as a main component and also containing any of Ni in an amount of 2 mass % to 30 mass %, Ir in an amount of 3 mass % to 40 mass %, and rhodium (Rh) in an amount of 3 mass % to 45 mass %.

A positional relationship between the ground electrode 27 and the ground electrode noble metal tip 32, and the like, in the embodiment will now be described. In the present embodiment, a tip distal end projection length A that is the shortest distance from the distal end portion 27*t* of the ground electrode 27 to a distal end portion 32*t* of the ground electrode noble metal tip 32 is set to range from 0.5 mm to 1.5 mm (e.g., 1 mm).

Moreover, a tip side surface projection length B that is the shortest distance from the center-electrode-side side surface 27*s*1 of the ground electrode 27 to a side surface of the ground electrode noble metal tip 32 facing the center electrode is set to range from 0.15 mm to 0.6 mm (e.g., 0.3 mm).

Provided that a direction approaching a base of the ground electrode 27 with reference to the distal end portion 27*t* of the ground electrode 27 when viewed from the distal-end side of the ground electrode 27 in the direction of the axial line CL1 is a negative direction and that a direction departing from the base of the ground electrode 27 with reference to the distal end portion 27*t* of the ground electrode 27 when viewed from the distal-end side of the ground electrode in the direction of the axial line CL1 is a positive direction, an inter-electrode distance C that is the shortest distance between the distal end portion of the ground electrode 27 and the imaginary outer periphery VG is set to range from −0.1 mm to 0.8 mm (e.g., +0.1 mm to 0.8 mm).

Next, the shape of the side surface of the ground electrode 27 of the present embodiment is described in detail. As shown in FIG. 4, a side surface 27*s*3 and a side surface 27*s*4 are provided between the center-electrode-side side surface 27*s*1 of the ground electrode 27 and a back-side side surface 27*s*2 situated on the back of the center-electrode-side side surface 27*s*1. In the present embodiment, a distance (in other words, the thickness of the ground electrode 27) between a surface of the center-electrode-side side surface 27*s*1 and a surface of the back-side side surface 27*s*2 is set to be; for instance, 1.3 mm; and a distance (in other words, the width of the ground electrode 27) between the side surface 27*s*3 and the side surface 27*s*4 is set to be; for instance, 2.7 mm (these numerals are mere example).

In addition, a first chamfered portion 27*m*1 is formed between the adjacent side surfaces 27*s*1 and 27*s*4; a second chamfered portion 27*m*2 is formed between the adjacent side surfaces 27*s*1 and 27*s*3; a third chamfered portion 27*m*3 is formed between the adjacent side surfaces 27*s*3 and 27*s*2; and a fourth chamfered portion 27*m*4 is formed between the adjacent side surfaces 27*s*2 and 27*s*4 (the first chamfered portion 27*m*1 and the second chamfered portion 27*m*2 are referred to as "gap-side chamfered portions," and the third chamfered portion 27*m*3 and the fourth chamfered portion 27*m*4 are referred to as "back-side chamfered portions").

In a cross section perpendicular to a center line (a center axis) CL2 of the ground electrode 27, the first chamfered portion 27*m*1 is set to have a thicknesswise length a1 that is achieved along the thicknesswise direction of the ground electrode 27 and that is 0.2 mm or more (e.g., 0.4 mm) and a widthwise length b1 that is achieved along the widthwise direction of the ground electrode 27 and that is 0.2 mm or more (e.g., 0.4 mm). Likewise, the second chamfered portion 27*m*2 has a thicknesswise length a2 that is achieved along the thicknesswise direction of the ground electrode 27 and that is 0.2 mm or more (e.g., 0.4 mm) and a widthwise length b2 that is achieved along the widthwise direction of the ground electrode 27 and that is 0.2 mm or more (e.g., 0.4 mm).

The third chamfered portion 27*m*3 and the fourth chamfered portion 27*m*4 are set to have thicknesswise lengths c1 and c2 that are achieved along the thicknesswise direction of the ground electrode 27 and that are 0.2 mm or more (e.g., 0.4 mm) and widthwise lengths d1 and d2 that are achieved along the widthwise direction of the ground electrode 27 and that are 0.2 mm or more (e.g., 0.4 mm). In the present embodiment, the thicknesswise lengths a1 and a2 are set to be identical with each other, and the widthwise lengths b1 and b2 are set to be identical with each other. Moreover, the thicknesswise lengths c1 and c2 are set to be identical with each other, and the widthwise lengths d1 and d2 are set to be identical with each other.

As shown in FIG. 5, at least one of the chamfered portions 27*m*1, 27*m*2, 27*m*3, and 27*m*4 (portions corresponding to the second chamfered portion 27*m*2 and the third chamfered portion 27*m*3 in the drawing) can also be embodied as curved surface portions 27*r*1 and 27*r*2 assuming the shape of a curved surface. The curved surface portion (a gap-side curved surface portion) 27*r*1 adjacent to the center-electrode-side side surface portion 27*s*1 is set so as to assume a curvature radius RS of 0.2 mm or more (e.g., 0.4 mm) in a cross section perpendicular to the center line CL2. The curved surface portion (a back-surface-side curved surface portion) 27*r*2 adjacent to the back-side side surface portion 27*s*2 is set so as to assume a curvature radius RB of 0.2 mm or more (e.g., 0.4 mm) in a cross section perpendicular to the center axis CL2. The curvature radius RS of the gap-side curved surface portion 27*r*1 and the curvature radius RB of the back-surface-side curved surface portion 27*r*2 do not need to be equal to each other. For instance, as shown in the same drawing, the curvature radius RS of the gap-side curved surface portion 27*r*1 may also be set so as to become smaller than the curvature radius RB of the back-surface-side curved surface portion 27*r*2.

In addition, as mentioned previously, the ground electrode noble metal tip 32 is joined to the ground electrode 27 in an embedded manner by means of resistance welding. For this reason, as shown in FIG. 6 and others, bulge portions 41 are formed so as to cover at least portions of the ground electrode 27 running along the center axis CL2 in the boundary between side surfaces of the ground electrode noble metal tip 32 and the center-electrode-side side surface 27*s*1 of the ground electrode 27. The bulge portions 41 include a metal material identical with a Ni alloy forming the outer layer 27 of the ground electrode 27.

Further, in the present embodiment, a height H of the bulge portions 41 with respect to the center-electrode-side side surface 27*s*1 of the ground electrode 27 is set to be 0.1 mm or more. In a direction in which the side surface of the ground electrode noble metal tip 32 facing the center electrode 5 protrudes with respect to the center-electrode-side side surface 27*s*1 of the ground electrode 27, the shortest distance between the bulge portions 41 and the side surface of the ground electrode noble metal tip 32 facing the center electrode 5 is taken as F and the shortest distance of the spark discharge gap 33 is taken as G, the spark plug is formed so as to satisfy F≧0.05G.

The shortest distance W1 between the first chamfered portion 27*m*1 and the bulge portion 41 achieved along the widthwise direction of the center-electrode-side side surface 27*s*1 is set to be 0.2 mm or more. Further, the shortest distance W2 between the second chamfered portion 27*m*2 and the bulge portion 41 achieved along the widthwise direction of the center-electrode-side side surface 27*s*1 is set to be 0.2 mm or more. Namely, the bulge portions 41 are formed so as not to reach the first chamfered portion 27*m*1 and the second chamfered portion 27*m*2, respectively.

A method for manufacturing the spark plug 1 configured as mentioned above will now be described. First, the metal shell 3 is processed in advance. Specifically, a through hole is formed in a columnar metal material (an iron-based material and a stainless steel material; for instance, S17C and S25C) by means of cold forging, thereby making a rough shape. The material is subsequently machined, to thus trim an outer shape and acquire a semi-manufactured metal shell.

Next, the ground electrode 27 is processed in advance. Specifically, a wire rod of two-layer structure including a Ni alloy and a copper alloy is drawn by use of a dice with a dice hole having an octagonal cross-sectional profile. The thus-drawn wire rod is cut to a predetermined length, whereby the ground electrode 27 having the respective chamfered portions 27*m*1 to 27*m*4 is obtained. The chamfered portions 27*m*1 to 27*m*4 may also be formed by performing machining operation in place of wire-drawing operation.

Subsequently, the ground electrode 27 is resistance-welded to a leading-end face of the semi-manufactured metal shell. Since a so-called "sag" occurs during welding, the thread 15 is formed in a predetermined portion of the semi-manufactured metal shell through rolling after removal of the "sag." The metal shell 3 to which the ground electrode 27 is welded is thus acquired. The metal shell 3 to which the ground electrode 27 is welded is subjected to zinc or nickel plating. In an attempt to enhance corrosion resistance, the surface of the metal shell 3 can further be plated with chrome.

In the meantime, the insulator 2 is molded in advance separately from the metal shell 3. For instance, a granulated molding base material is prepared by use of a powdery material that includes alumina as a main component and that contains a binder, and the like, and rubber press molding is performed by use of the granulated substance, whereby a cylindrical molded element is obtained. The thus-obtained molded element is machined, to thus be trimmed. The thus-trimmed element is charged into a kiln and sintered, whereby the insulator 2 is obtained.

Separately from the metal shell 3 and the insulator 2, the center electrode 5 is previously manufactured. Specifically, a Ni alloy is forged, and the inner layer 5A made of a copper alloys is provided at the center of the Ni alloy in an attempt to enhance a heat radiation characteristic. Next, the center electrode noble metal tip 31 is laser-welded to the leading-end face of the center electrode 5. More specifically, after the leading-end face of the center electrode 5 and an end face of the center electrode noble metal tip 31 are stacked one on top of the other, a contact portion between the faces is exposed to a laser beam, whereby a fused portion 35 is formed. Thus, the center electrode 5 and the center electrode noble metal tip 31 are joined together.

The insulator 2, the center electrode 5, the resistor 7, and the terminal electrode 6, which are thus acquired, are fixedly sealed by glass seal layers 8 and 9. The glass seal layers 8 and 9 are usually prepared by mixing together borosilicate glass and metal powder. The thus-prepared substance is poured into the axial hole 4 of the insulator 2 in such a way that the resistor 7 is sandwiched, and the prepared substance is subsequently pressed by the terminal electrode 6 from behind while the insulator is heated in the kiln, whereby the glass seal layer is fired and hardened. At this time, a glazing layer can also be simultaneously sintered over the surface of the body 10 on the base-end side of the insulator 2, or the glazing layer can also be formed in advance.

Subsequently, the insulator 2 with the center electrode 5 and the terminal electrode 6, which are manufactured as mentioned above, and the metal shell 3 with the ground electrode 27 are assembled together. More specifically, the opening that is comparatively, thinly formed on the base-end side of the metal shell 3 is crimped inwardly with respect to the radial direction; namely, the crimping portion 20 is formed, whereby the insulator 2 and the metal shell 3 are fastened together.

Next, the ground electrode noble metal tip 32 is resistance-welded to the distal end of the ground electrode 27. More specifically, as shown in FIG. 7, one end of the ground electrode noble metal tip 32 is laid over the distal end of the center-electrode-side side surface 27*s*1 of the ground electrode 27, and the ground electrode 27 and the ground electrode noble metal tip 32 are sandwiched between a pair of electrodes D1 and D2. Power is applied across the electrodes D1 and D2, whereby the ground electrode 27 and the ground electrode noble metal tip 32 are joined together while a portion of the tip is embedded in the electrode. At this time, of the pair of electrodes D1 and D2, the electrode D2 supporting the ground electrode noble metal tip 32 is equipped with a receiving portion RP serving as relative movement regulation means. Relative movement of the ground electrode noble metal tip 32 toward the distal-end side of the ground electrode 27 can thereby be prevented, and the ground electrode noble metal tip 32 can be joined more reliably to an appropriate position on the ground electrode 27. The bulge portions 41 are formed as a result of resistance welding of the ground electrode noble metal tip 32.

Finally, the ground electrode 27 is bent, thereby performing operation for adjusting the spark discharge gap 33 between the center electrode noble metal tip 31 provided on the center electrode 5 and the ground electrode noble metal tip 32 provided on the ground electrode 27.

The spark plug 1 having the above-described configuration is thus manufactured through a series of processes.

Next, in order to ascertain an effect yielded by the present embodiment, an ignitability evaluation test, a durability evaluation test, and a ground electrode flying spark count measurement test were conducted. General descriptions about the ignitability evaluation test, the durability evaluation test, and the ground electrode flying spark count measurement test are as follows. Specifically, in the ignitability evaluation test, there were manufactured sample spark plugs that were variously changed in terms of a tip distal end projection length "A," a tip side surface projection length "B," an inter-electrode distance "C," presence of a gap-side chamfered portion and a back-side chamfered portion, and a thickness-wise length "c" and a widthwise length "d" (a curvature radius "rb" of a curved surface portion when a curved surface portion is provided) of the back-side chamfered portion within a cross section perpendicular to the center axis of the ground electrode. Each of the samples was equipped with an igniter, and the respective samples were arranged within a test chamber. In addition, a direction of fuel injection was taken as a lateral side of the ground electrode ["direction X"; (a direction of an outlined arrow shown in FIG. 3)] or a direction toward the back surface of the ground electrode [direction Y; (an outlined arrow direction in FIG. 2)], and the portion of a flame kernel achieved at a point in time when 3 ms has elapsed after firing was measured. When the portion of the measured flame kernel is 70 $mm^2$ or more, an evaluation of "O" is given to the spark plug as exhibiting superior ignitability. In the meantime, when the portion of the flame kernel is less than 70 $mm^2$, an evaluation of "X" is given to the spark plug as exhibiting insufficient ignitability.

The durability evaluation test was conducted as follows. The samples each were attached to an in-line, three-cylinder test engine having a piston displacement of 660 cc and a 5° BTDC time. An extent to which the spark discharge gap was increased (the amount of increase in gap achieved) after the engine was driven at 4000 rpm over 300 hours at an air-fuel ratio of 10.7 was measured. When the amount of increase in gap is less than 0.2 mm, the evaluation of "O" is given to the sample as exhibiting superior durability. In contrast, when the amount of increase in gap is 0.2 mm or more, the evaluation of "X" is given to the sample as exhibiting poor durability.

Further, the ground electrode flying spark count measurement test was performed as follows. Specifically, igniters are attached to respective samples variously changed in terms of the thicknesswise length "a" of the gap-side chamfered portion, the widthwise length "b" of the same, and the curvature "rs" of the gap-side curved surface portion. The samples were placed in a chamber that is made of quartz glass and that enables viewing of an inner of the chamber, and electrical discharge was performed while the internal pressure of the chamber was held at 0.4 Mpa. Electrical discharges were photographed, and the number of flying spark (a ground electrode flying spark count) occurred per 100 discharges between the center electrode noble metal tip and the ground electrode was measured on the basis of the photographed images. In normal times, electrical discharge arises in the smallest gap between the center electrode noble metal tip and the ground electrode noble metal tip. However, when the ground electrode includes an edge, and the like, where field intensity is enhanced, an electrical discharge arises in a slightly-large gap between the center electrode noble metal tip and the ground electrode, which may induce deterioration of ignitability or uneven wear of the ground electrode. Accordingly, when the ground electrode flying spark count is zero, the evaluation of "O" is given to the sample as exhibiting superior ignitability and having the very small potential of inducing uneven wear of the ground electrode. In the meantime, the ground electrode flying spark count is one or more, the evaluation of "X" is given to the sample as exhibiting poor ignitability or as having a potential of inducing uneven wear of the ground electrode.

Table 1 and FIGS. 8 through 15 show results of the ignitability evaluation test and the durability evaluation test.

In the tests provided in Table 1, when the gap-side chamfered portion is classified as "present," both the thicknesswise length "a" and the widthwise length "b" of the gap-side chamfered portion are set to 0.4 mm. Further, when the back-side chamfered portion is classified as "present," both the thicknesswise length "c" and the widthwise length "d" are set to 0.4 mm.

A graph of FIG. 8 shows results of the ignitability evaluation test acquired when attention is paid to samples differing from each other in terms of only presence and absence of the chamfered portion. A graph of FIG. 9 shows results acquired in connection with the samples differing from each other in terms of only presence and absence of the back-side chamfered portion by paying attention to changes in ignitability induced by a difference in the direction of fuel injection. In addition, graphs of FIGS. 10 and 11 show results of the ignitability evaluation test and the durability evaluation test acquired when attention is paid to samples differing from each other in terms of only the value of "A." Graphs of FIGS. 12 and 13 show results of both evaluation tests acquired when attention is paid to samples differing from each other in terms of only the value of "B." Graphs of FIGS. 14 and 15 show results of both evaluation tests acquired when attention is paid to samples differing from each other in terms of only the value of "C."

TABLE 1

| | | | | CHAMFERED PORTION | | | | DURABILITY [GAP INCREASE | | DIRECTION |
|---|---|---|---|---|---|---|---|---|---|---|
| SAMPLE No. | A (mm) | B (mm) | C (mm) | GAP SIDE | BACK SIDE | IGNITABILITY ($mm^2$) | IGNITABILITY EVALUATION | AMOUNT] (mm) | DURABILITY EVALUATION | OF FUEL INJECTION |
| 1 | 1 | 0.3 | 0.3 | ABSENT | ABSENT | 66 | X | 0.13 | ○ | X |
| 2 | 0.5 | 0.3 | 0.1 | ABSENT | ABSENT | 68 | X | 0.11 | ○ | X |
| 3 | 0.5 | 0.3 | 0.4 | ABSENT | ABSENT | 69 | X | 0.14 | ○ | X |
| 4 | 1 | 0.3 | 0.3 | PRESENT | PRESENT | 75 | ○ | 0.123 | ○ | X |
| 5 | 0.5 | 0.3 | 0.1 | PRESENT | PRESENT | 74 | ○ | 0.11 | ○ | X |
| 6 | 0.5 | 0.3 | 0.4 | PRESENT | PRESENT | 75 | ○ | 0.14 | ○ | X |
| 7 | 0.5 | 0.3 | 0.1 | PRESENT | PRESENT | 73 | ○ | 0.11 | ○ | Y |
| 8 | 0.5 | 0.3 | 0.1 | PRESENT | ABSENT | 75 | ○ | 0.11 | ○ | X |
| 9 | 0.5 | 0.3 | 0.1 | PRESENT | ABSENT | 68 | X | 0.11 | ○ | Y |
| 10 | 0 | 0.3 | −0.7 | PRESENT | PRESENT | 49 | X | 0.090 | ○ | X |
| 11 | 0.2 | 0.3 | −0.5 | PRESENT | PRESENT | 59 | X | 0.093 | ○ | X |
| 12 | 0.5 | 0.3 | −0.2 | PRESENT | PRESENT | 70 | ○ | 0.101 | ○ | X |
| 13 | 0.6 | 0.3 | −0.1 | PRESENT | PRESENT | 72 | ○ | 0.104 | ○ | X |
| 14 | 0.7 | 0.3 | 0 | PRESENT | PRESENT | 73 | ○ | 0.107 | ○ | X |
| 15 | 0.8 | 0.3 | 0.1 | PRESENT | PRESENT | 74 | ○ | 0.111 | ○ | X |
| 16 | 1.3 | 0.3 | 0.6 | PRESENT | PRESENT | 76 | ○ | 0.150 | ○ | X |
| 17 | 1.5 | 0.3 | 0.8 | PRESENT | PRESENT | 76 | ○ | 0.189 | ○ | X |
| 18 | 1.6 | 0.3 | 0.9 | PRESENT | PRESENT | 76 | ○ | 0.213 | X | X |
| 19 | 0.5 | 0.15 | 0.1 | PRESENT | PRESENT | 70 | ○ | 0.10 | ○ | X |
| 20 | 0.5 | 0 | 0.1 | PRESENT | PRESENT | 65 | X | 0.09 | ○ | X |
| 21 | 0.5 | 0.6 | 0.1 | PRESENT | PRESENT | 76 | ○ | 0.15 | ○ | X |
| 22 | 0.5 | 1 | 0.1 | PRESENT | PRESENT | 77 | ○ | 0.22 | X | X |

When consideration is given to the samples differing in terms of presence and absence of a chamfered portion (samples 1 through 6), Table 1 and the graph of FIG. 8 show that samples (samples 1 through 3) not having a chamfered portion exhibit poor ignitability and that chamfered samples (samples 4 through 6) exhibit superior ignitability. A conceivable reason for them is that provision of the chamfered portion results in a relative decrease in the number of flying sparks between the center electrode noble metal tip and the ground electrode, which in turn makes it possible to relatively separate the location of occurrence of a flame kernel from the ground electrode.

Table 1 and the graph of FIG. 9 show that samples (samples 5 and 7) each having both the gap-side chamfered portion and the back-side chamfered portion can implement superior ignitability when compared with samples (samples 8 and 9) having only the gap-side chamfered portion, even when the samples are oriented in direction Y in terms of the direction of the fuel injection and in an environment in which ignitability is likely to be deteriorated. Specifically, the ground electrode can be said to have to include both a gap-side chamfered portion and a back-side chamfered portion in an attempt to enhance ignitability.

Moreover, consideration is given to samples (4 and 10 to 18) differing from each other in terms of only the value "A" (changes in value C are attributable to changes in the value A) as shown in Table 1 and the graph of FIG. 10, samples (4 and 12 to 18) having 0.5 mm or more of the value A are confirmed to exhibit superior ignitability. A conceivable reason for this is that, since the ground electrode can be comparatively separated from the spark discharge gap, a larger space for growing a flame kernel can be assured and that heat dissipation of the flame kernel, which would otherwise be caused by the ground electrode, can be prevented to a much greater extent.

In the meantime, when the samples are evaluated from the viewpoint of durability, the sample (sample 18) whose value "A" exceeds 1.5 mm is understood to exhibit insufficient durability as shown in Table 1 and the graph of FIG. 11. A conceivable reason for this is deterioration of performance for dissipating heat of the ground electrode noble metal tip.

From the above results, setting the value "A" so as to range from 0.5 mm to 1.5 mm can be said to be preferable in order to exhibit superior function in terms of both ignitability and durability. FIG. 10 shows that samples (samples 4 and 13 to 17) having 0.6 mm or more of the value "A" exhibit much superior ignitability and that samples (samples 4 and 16 to 17) having 1.0 mm or more of the value "A" exhibit particularly-superior ignitability. Accordingly, from the viewpoint of enhancement of ignitability, setting the value "A" to 0.6 mm or more can be said to be preferable, and setting the value A to 1.0 mm or more can be said to be more preferable.

A consideration is given to samples (samples 5 and 19 to 22) differing from each other in terms of only a value "B," samples having 0.15 mm or more of the value "B" (samples 5, 19, 21, and 22) are understood to exhibit superior ignitability as shown in Table 1 and the graph of FIG. 12. A conceivable reason for this is that spark discharge can be caused to occur between the noble metal tips more reliably and that heat dissipation of the flame kernel, which would otherwise be caused by the ground electrode, can be prevented more thoroughly.

As shown in the graph of FIG. 12, it can be said that an attempt can be made further to enhance ignitability as the value "B" increases. Accordingly, from the viewpoint of enhancement of ignitability, setting the value "B" to 0.3 mm or more can be said to be more preferable. However, there is apprehension that durability would be decreased with an increase in the value "B," as shown in the graph of FIG. 13. Therefore, in order to prevent deterioration of durability, setting the value "B" to 0.8 mm or less can be said to be desirable. In order to prevent deterioration of durability more thoroughly, setting the value "B" to 0.6 mm or less can be said to be more desirable.

Further, a consideration is given to samples (samples 5, 6, and 12) differing from each other in terms of only a value "C," it has become obvious that the respective samples have superior ignitability and that samples having 0.1 mm or more of the value "C" (samples 5 and 6) exhibit quite superior ignitability as shown in Table 1 and the graph of FIG. 14. Accordingly, in order to make an attempt to enhance ignitability to a much greater extent, setting the value "C" to 0.1 mm or more is preferable. Moreover, as shown in the graph of FIG. 14, in consideration of the fact that ignitability is enhanced with an increase in the value C, setting the value C to 0.2 mm or more can be said to be more preferable. However, as shown in the graph of FIG. 15, there is apprehension that durability would be deteriorated as the value C increases. For this reason, setting the value C to 0.8 mm or less can be said to be preferable.

Table 2 shows results of the ignitability evaluation test acquired when the samples changed particularly in terms of the thicknesswise length "c" and the widthwise length "d" of the back-side chamfered portion or the curvature radius "rb" of the curved portion were subjected to the test while the direction of fuel injection was set to "direction Y." In the test, the values "A," "B," "C," "a," and "b" were made equal to their counterparts of sample 5 (i.e., "A"=0.5 mm, "B"=0.3 mm, "C"=0.1 mm, "a"=0.4 mm, and "b"=0.4 mm). When a curved surface portion was provided, a curved surface portion was provided at positions corresponding to the third chamfered portion and the fourth chamfered portion.

TABLE 2

| SAMPLE No. | c (mm) | d (mm) | rb (mm) | IGNITABILITY ($mm^2$) | IGNITABILITY EVALUATION | DIRECTION OF FUEL INJECTION |
|---|---|---|---|---|---|---|
| 7 | 0.4 | 0.4 | — | 73 | ○ | Y |
| 9 | 0 | 0 | 0 | 68 | X | Y |
| 23 | 0.2 | 0.2 | — | 70 | ○ | Y |
| 24 | — | — | 0.2 | 70 | ○ | Y |
| 25 | 0.4 | 0.3 | — | 71 | ○ | Y |
| 26 | 0.3 | 0.4 | — | 72 | ○ | Y |
| 27 | 0.15 | 0.4 | — | 69 | X | Y |
| 28 | — | — | 0.15 | 69 | X | Y |
| 29 | — | — | 0.3 | 71 | ○ | Y |
| 30 | — | — | 0.4 | 72 | ○ | Y |

Table 2 shows that samples (samples 7, 23 to 26, 29, and 30) having 0.2 mm or more of the values "c" and "d" or the value "rb" can attain superior ignitability even when the direction of fuel injection is "direction Y." A conceivable reason for this is that a mixed air becomes easier to flow into the spark discharge gap by passing around the ground electrode as a result of provision of the back-side chamfered portion. It is clear that samples (samples 7, 25, 26, 29, and 30) having 0.3 mm or more of the values "c" and "d" or the value "rb" exhibit much enhanced ignitability than do samples (samples 23 and 24) having 0.2 mm of the values "c" and "d" or the value "rb." Accordingly, from the viewpoint of further enhancement of ignitability, setting the values "c" and "d" or the value "rb" to 0.3 mm or more can be said to be preferable.

Next, results of ground electrode flying spark count measurement test are provided in Table 3. In the test, the values "A," "B," "C," "c," and "d" were made equal to their counterparts of the sample 5. When a curved surface portion was provided, a curved surface portion was provided at positions corresponding to the first chamfered portion and the second chamfered portion.

TABLE 3

| SAMPLE No. | a (mm) | b (mm) | rs (mm) | NUMBER OF GROUND ELECTRODE FLYING SPARKS (NUMBER OF TIMES) | EVALUATION OF FLYING SPARKS NUMBER |
|---|---|---|---|---|---|
| 2 | 0 | 0 | 0 | 10 | X |
| 5 | 0.6 | 0.3 | — | 0 | ○ |
| 31 | 0.2 | 0.2 | — | 0 | ○ |
| 32 | — | — | 0.2 | 0 | ○ |
| 33 | 0.6 | 0.15 | — | 3 | X |
| 34 | 0.3 | 0.3 | — | 0 | ○ |
| 35 | 0.15 | 0.3 | — | 8 | X |
| 36 | — | — | 0.15 | 6 | X |
| 37 | — | — | 0.3 | 0 | ○ |

As shown in Table 3, a consideration is given to samples (samples 2, 5, and 31 to 37) differing from each other in terms of the sizes of the gap-side chamfered portion and the curved surface portion, it is ascertained that the samples (samples 5, 31, 32, 34, and 37) having 0.2 mm or more of the values "a" and "b" or the value "rs" do not cause spark discharge from the ground electrode and that extremely-superior durability and ignitability can be attained. A conceivable reason for them is that formation of angular portions (edges) on which an electric field is likely to concentrate between the center-electrode-side side surface and both side surfaces located adjacent to the center-electrode-side side surface could be prevented and, by extension, occurrence of spark discharge between the center electrode noble metal tip and the ground electrode could be prevented. From the viewpoint of more thorough prevention of formation of angular portions (edges) between the side surfaces, making the values "a" and "b" or the value "rs" larger is desirable. Therefore, in order to further enhance ignitability, setting the values "a" and "b" or the value "rs" to 0.3 mm or more can be said to be more preferable.

Next, an inter-electrode distance was set to −0.1 mm or 0.1 mm, and sample spark plugs having variously-changed ratios (F/G) were manufactured, wherein the ratio is a ratio of the shortest distance "G" of a spark discharge gap to the shortest distance "F" between the bulge portions and the center-electrode-side side surface of the ground electrode noble metal tip with respect to the direction in which the center-electrode-side side surface of the ground electrode noble metal tip protrudes from the center-electrode-side side surface of the ground electrode. Each of the samples was placed in the chamber that is made of quartz glass and that enables viewing of an inner of the chamber, and electrical discharge was performed while the internal pressure of the chamber was held at 0.4 Mpa. Electrical discharge performed this time was photographed, and a rate of flying spark (a bulge portion flying spark rate) occurred per 100 discharges between the center electrode noble metal tip and the bulge portions was measured on the basis of the photographed images. FIG. 16 shows a graph representing a relationship between "FIG" and the bulge portion flying spark rate. In the drawings, test results of the samples whose inter-electrode distance is set to −0.1 mm are plotted by solid circles, and test results of the samples whose inter-electrode distance is set to 0.1 mm are plotted by solid triangles.

As shown in FIG. 16, it has become clear that, in connection with the samples whose inter-electrode distance is set to −0.1 mm, a bulge portion flying spark rate comes to 0% when the F/G is set to a value of 0.1 or more, whereby occurrence of spark discharge to the bulge portions is prevented and that, in connection with the samples whose inter-electrode distance is set to 0.1 mm, a bulge portion flying spark rate comes to 0% when the F/G is set to a value of 0.05 or more, whereby occurrence of spark discharge to the bulge portions is prevented. A conceivable reason for them is that a gap between the center electrode noble metal tip and the bulge portions is formed to a sufficient size.

Next, straight-rod-shaped sample ground electrodes variously modified in terms of the height "H" of the bulge portions with reference to the center-electrode-side side surface of the ground electrode were made. The samples were subjected to a desk burner evaluation test [a test performing 1000 cycles of operations, each cycle including: heating a sample for two minutes by a burner such that a ground electrode noble metal tip comes to 1050° C.; and slowly cooling the thus-heated sample is slowly cooled for one minute]. A cross section of each of the thus-tested samples was observed, thereby measuring a ratio (a junction ratio) of a length of a boundary portion between the ground electrode and the ground electrode noble metal tip to a length of a region (a junction) of the boundary portion where there is no development of an oxidized scale. Table 4 shows a relationship between the height of the bulge portions and the junction ratio.

TABLE 4

| HEIGHT H | JUNCTION RATIO |
|---|---|
| 0.05 mm | 34% |
| 0.1 mm | 52% |

TABLE 4-continued

| HEIGHT H | JUNCTION RATIO |
|---|---|
| 0.2 mm | 63% |
| 0.3 mm | 70% |

Table 4 shows that junction ratios of the respective samples having bulge portions exceed 30%, thereby yielding a superior effect of inhibiting the development of the oxidized scale. A conceivable reason for this is that intrusion of oxygen into the boundary portion between the ground electrode and the ground electrode noble metal tip was effectively inhibited as a result of formation of the bulge portions. In particular, the junction ratios of the samples whose bulge portions having a height "H" of 0.1 mm or more obviously exceed 50%, and the junction ratios of the samples whose bulge portions having a height "H" of 0.2 mm or more obviously exceed 60%. From the viewpoint of yielding of a much superior effect of inhibiting the development of the oxidized scale, setting the height "H" of the bulge portions to 0.1 mm or more can be said to be more preferable, and setting the height "H" of the bulge portions to 0.2 mm or more can be said to be much more preferable.

From the test results set forth, it can be said that setting a tip distal end projection length to a range from 0.5 mm to 1.5 mm, setting a tip side surface projection length to a range from 0.15 mm to 0.6 mm, providing chamfered portions (curved portions) on both a gap side and a back side, and setting the thicknesswise and widthwise lengths of each of the chamfered portions and the radial curvature of the curved portions to 0.2 mm or more are necessary to exhibit sufficient durability and achieve superior ignitability regardless of an attached state.

In addition, it can be said that much superior ignitability can be realized by setting the tip distal end projection length to 0.6 mm or more and setting the thicknesswise length and the widthwise length of each of the chamfered portions to 0.3 mm or more.

Moreover, from the viewpoint of inhibition of development of the oxidized scale in the junction between the ground electrode and the ground electrode noble metal tip, providing bulge portions can be said to be significant; particularly, setting the height of the bulge portions to 0.1 mm or more can be said to be very significant.

In the meantime, from the viewpoint of inhibition of occurrence of spark discharge between the bulge portions and the center electrode noble metal tip and further enhancement of ignitability and durability, setting the inter-electrode distance to −0.1 mm or more and "F/G" to 0.1 mm or more (setting "F/G" to 0.05 or more when the inter-electrode distance is set to 0.1 mm or more) can be said to be preferable.

A method for manufacturing the spark plug of the present embodiment is now referred to. Relative movement of the ground electrode noble metal tip 32 can be regulated as a result of provision of a receiving portion RP, whereas there is a concern about a problem, such as collapse of the ground electrode noble metal tip 32. In contrast, the ground electrode noble metal tip 32 of the present embodiment is made of a noble metal alloy (e.g., Pt-10Ir alloy, and the like) containing Pt as the main component and also containing any of nickel in an amount of 2 mass % to 30 mass %, Ir in an amount of 3 mass % to 40 mass %, and Rh in an amount of 3 mass % to 45 mass %. Therefore, the ground electrode noble metal tip 32 exhibits sufficient strength, and the concern about collapse of the ground electrode noble metal tip 32, which would otherwise be caused during resistance welding, and the like, can be wiped off. Specifically, when the method for manufacturing a spark plug of the embodiment is adopted, it is preferable to form the ground electrode noble metal tip 32 from a noble metal alloy consisting of the foregoing composition.

The present invention is not limited to the descriptions of the embodiment and may also be implemented, for example, in a manner mentioned below. As a matter of course, another applied example and a modified example, which are not illustrated below, are also feasible.

(a) In the embodiment, the inter-electrode distance C between the distal-end face 27*t* of the ground electrode 27 and the imaginary outer periphery VG is set to −0.1 mm to 0.8 mm; however, the inter-electrode distance C is not limited to numerals falling within the range. Accordingly, for instance, the inter-electrode distance C may also be set to 0.1 mm or more.

(b) In the embodiment, the thicknesswise lengths a1 and a2 of the chamfered portions 27*m*1 and 27*m*2 are made equal to each other, and the widthwise lengths b1 and b2 of the same are made equal to each other. However, the thicknesswise lengths a1 and a2 may also be made different from each other, and the widthwise lengths b1 and b2 may also be made different from each other. The thicknesswise lengths c1 and c2 of the chamfered portions 27*m*3 and 27*m*4 are made equal to each other, and the widthwise lengths d1 and d2 of the same are made equal to each other. However, the thicknesswise lengths c1 and c2 may also be made different from each other, and the widthwise lengths d1 and d2 may also be made different from each other. Accordingly, as shown, for example, in FIG. 17, widths MW1 and MW2 of the chamfered portions 27*m*1 and 27*m*2 facing the center electrode 5 may also be set so as to become smaller than widths MW3 and MW4 of the back-side chamfered portions 27*m*3 and 27*m*4. In this case, when compared with a case where the chamfered portions 27*m*1 and 27*m*2 are set so as to become essentially identical with the chamfered portions 27*m*3 and 27*m*4 in terms of a width, the ground electrode 27 can be made thicker, and an attempt can be made to enhance mechanical strength (durability) of the ground electrode 27. On the occasion of adoption of the configuration shown in the drawings, assuring a comparatively-large inter-electrode distance C (of e.g., +0.1 mm or more) is desirable in such a way that an effect of inhibiting occurrence of spark discharge between the ground electrode 27 and the center electrode noble metal tip 31, which is attributable to provision of the chamfered portions 27*m*1 and 27*m*2, is sufficiently yielded.

(c) The composition of the ground electrode noble metal tip 32 is not limited to the composition described in connection with the embodiment. Accordingly, for instance, the ground electrode noble metal tip 32 can also be made of a noble metal alloy, or the like, containing Ir as the main component.

(d) In the embodiment, the shape of the ground electrode noble metal tip 32 is a rectangular parallelepiped. However, the shape may also be, for example, a prismatic shape assuming a hexagonal cross-sectional profile. Further, the shape of the ground electrode noble metal tip 32 is not limited to a prismatic shape and may also be; for instance, columnar or the like.

(e) The embodiment provides materialization of the case where the ground electrode 27 is joined to the leading-end face of the metal shell 3. The present invention can also be applied to a case where a ground electrode is made by chipping a part of the metal shell (or a part of leading-end hardware previously welded to the metal shell) (e.g., JP-A-2006-236906, and the like). Moreover, the ground electrode 27 can also be joined to a side surface of the leading end portion 26 of the metal shell 3.

(f) In the embodiment, the tool engagement portion 19 is made so as to assume a hexagonal cross-sectional profile. However, the tool engagement portion 19 is not limited to such a shape. For instance, the tool engagement portion may also be made so as to assume a Bi-HEX (deformed dodecagonal) shape [ISO22977:2005(E)], or the like.

DESCRIPTION OF REFERENCE SIGNS

Figure 1:
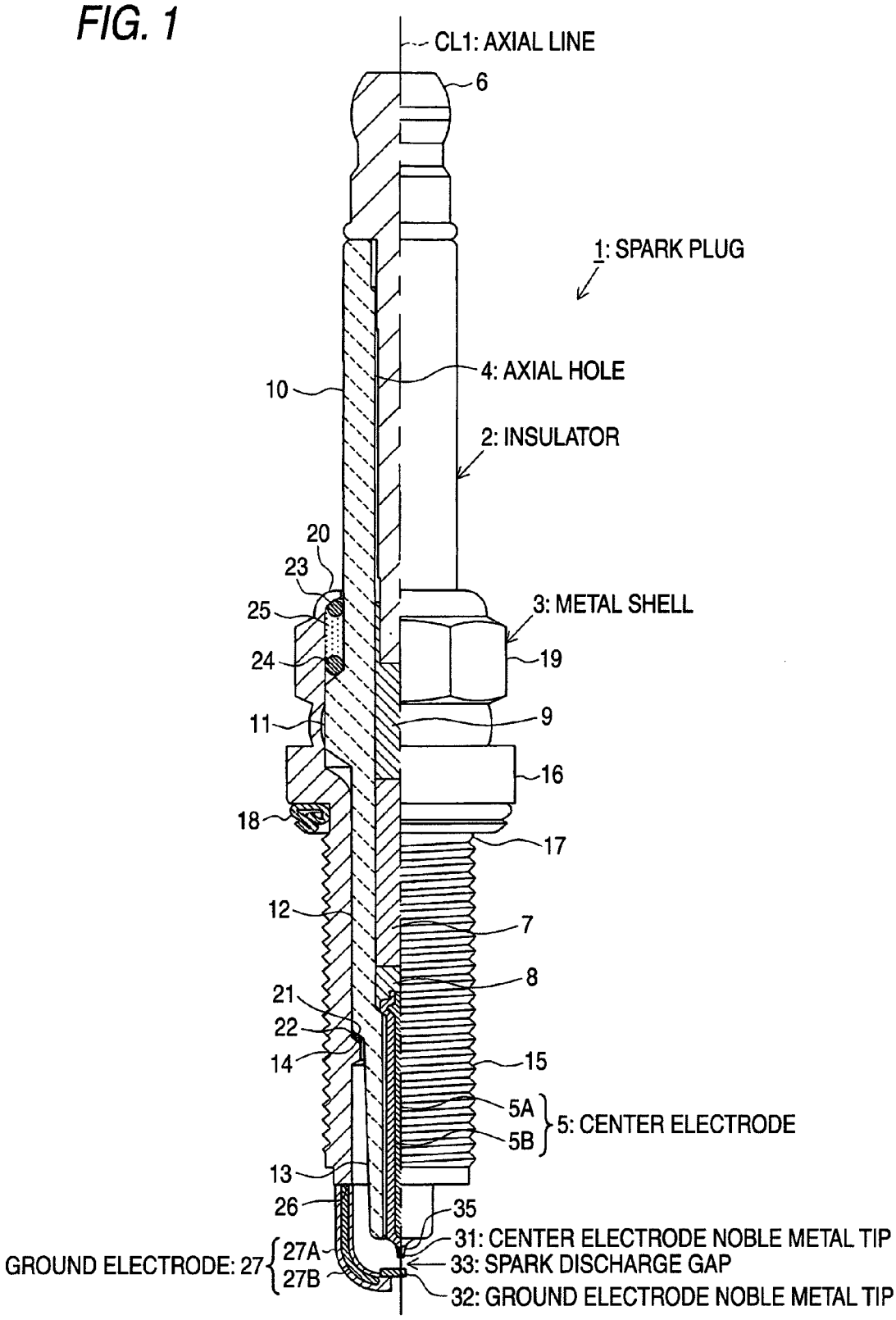
FIG. 1 is a partially-cutaway front view showing a structure of a spark plug of an embodiment.
Figure 2:
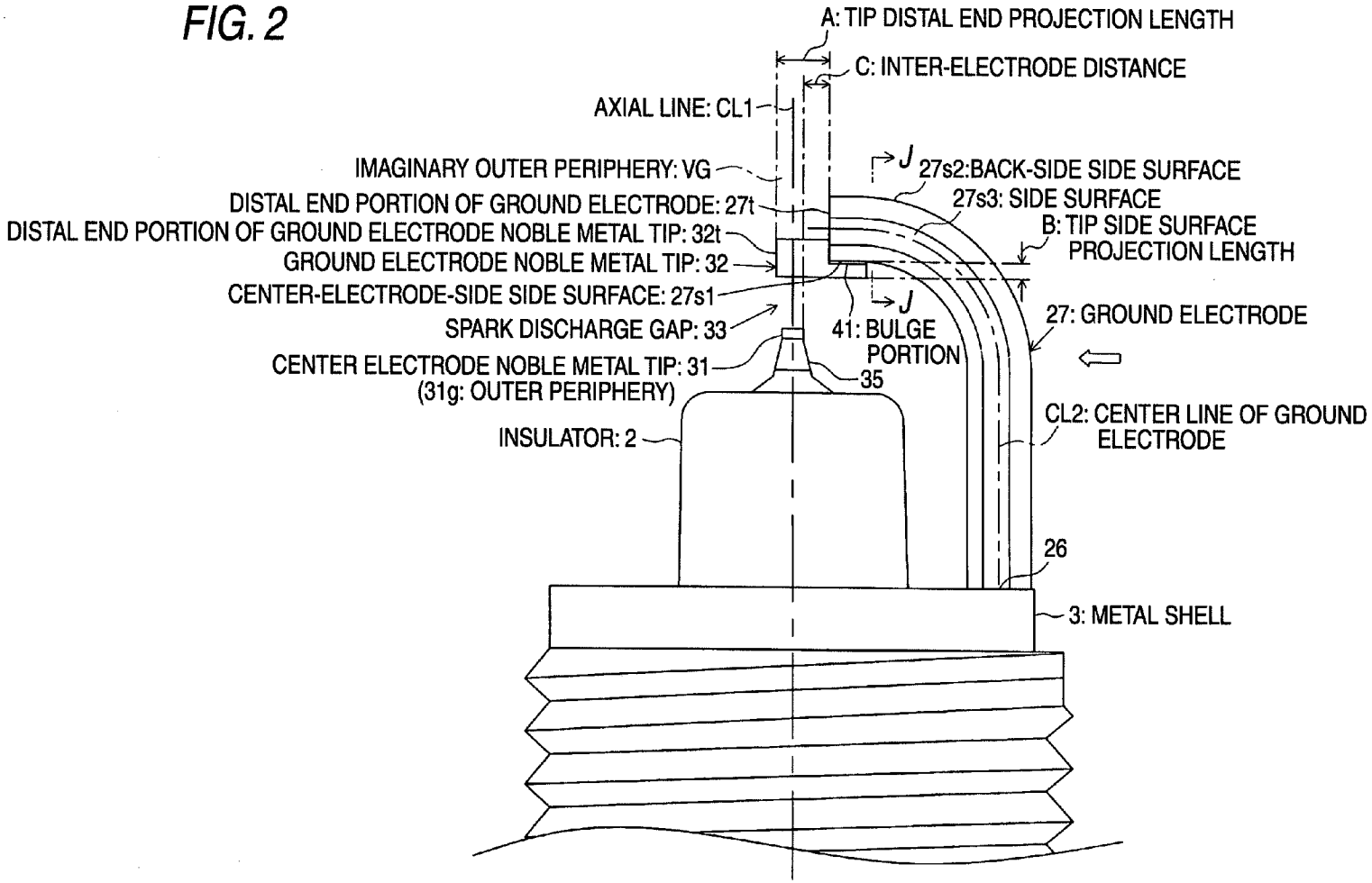
FIG. 2 is a partially-enlarged front view showing the structure of a leading end of the spark plug.
Figure 3:
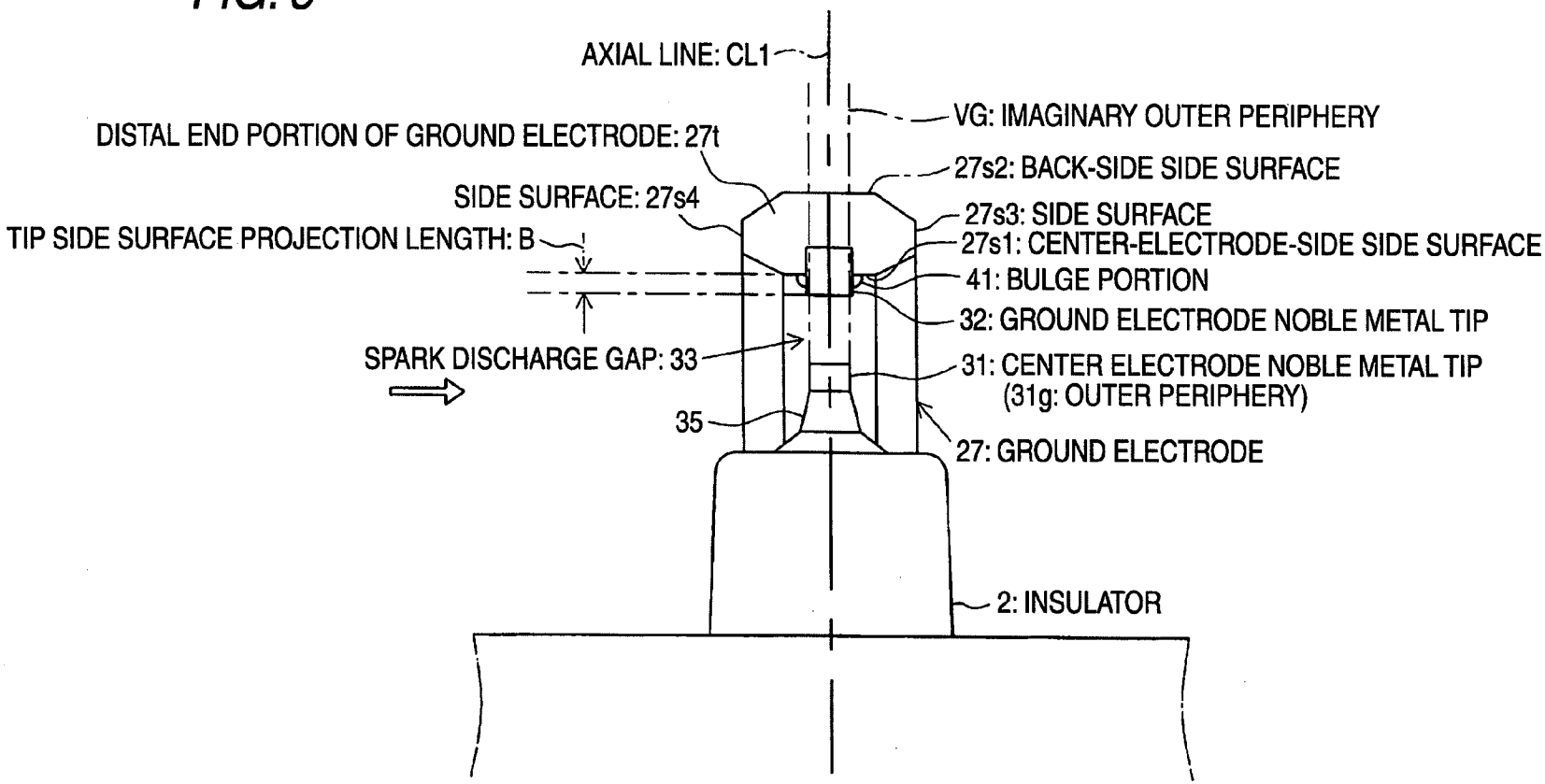
FIG. 3 is a partially-enlarged side view showing the structure of the leading end of the spark plug.
Figure 4:
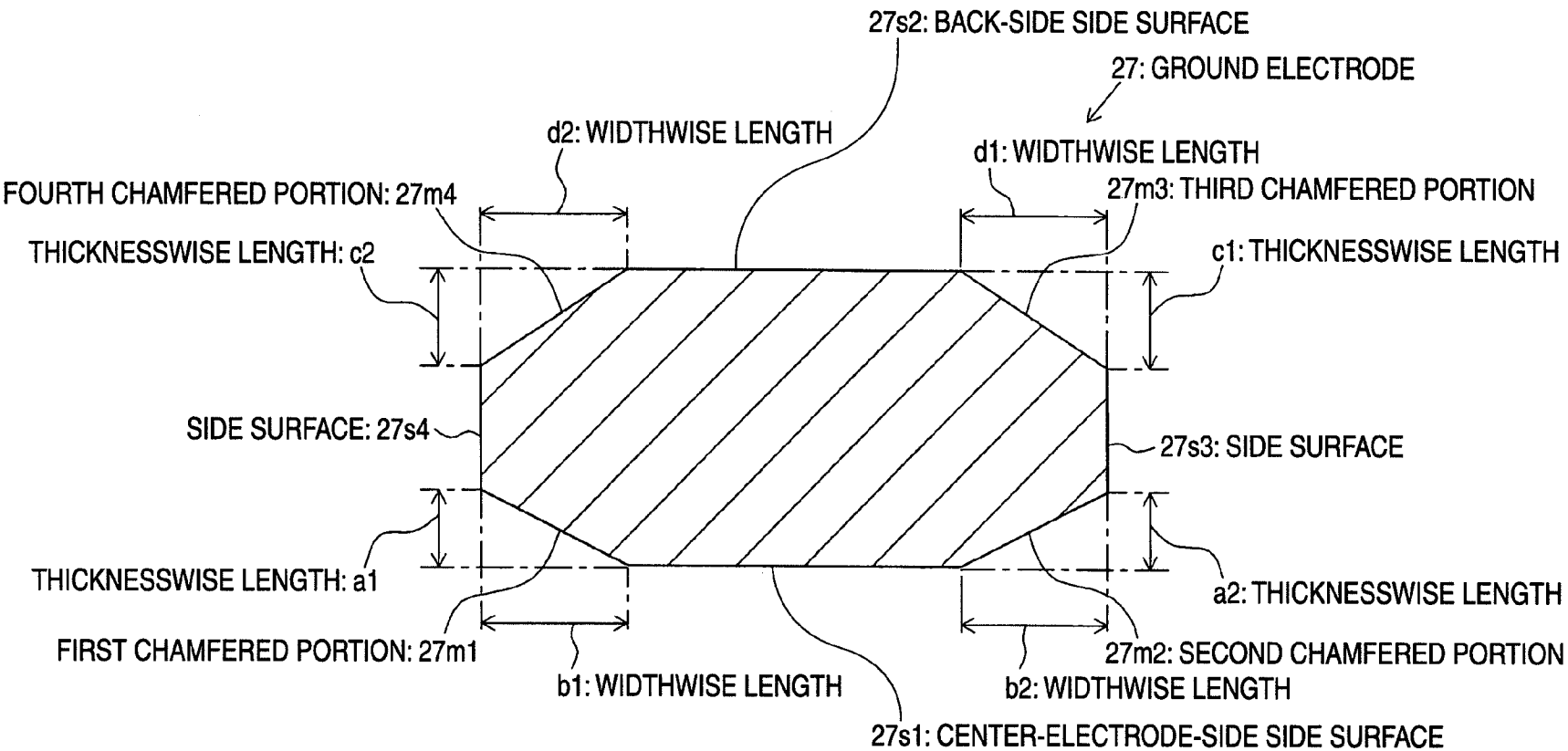
FIG. 4 is a cross-sectional view taken along line J-J shown in FIG. 2.
Figure 5:
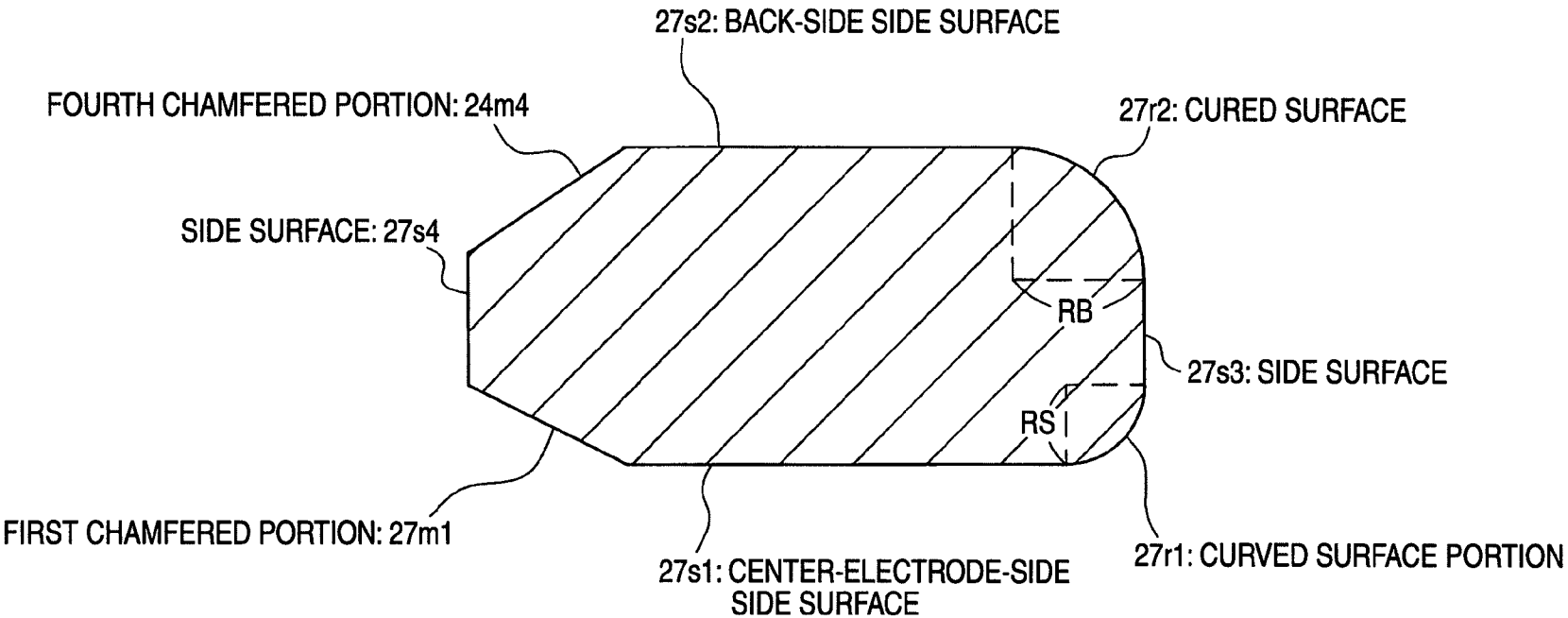
FIG. 5 is a partially-enlarged cross-sectional view showing a cross-sectional profile, and the like, of a ground electrode of another embodiment.
Figure 6:
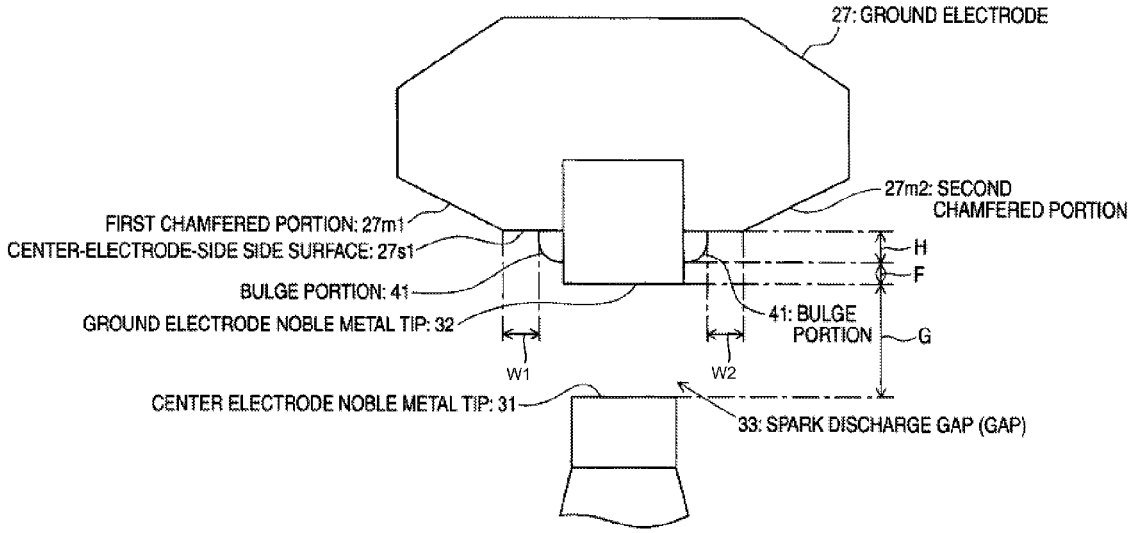
FIG. 6 is a partially-enlarged side view showing a positional relationship among a ground electrode noble metal tip, a center electrode noble metal tip, bulge portions, chamfered portions, and others.
Figure 7:
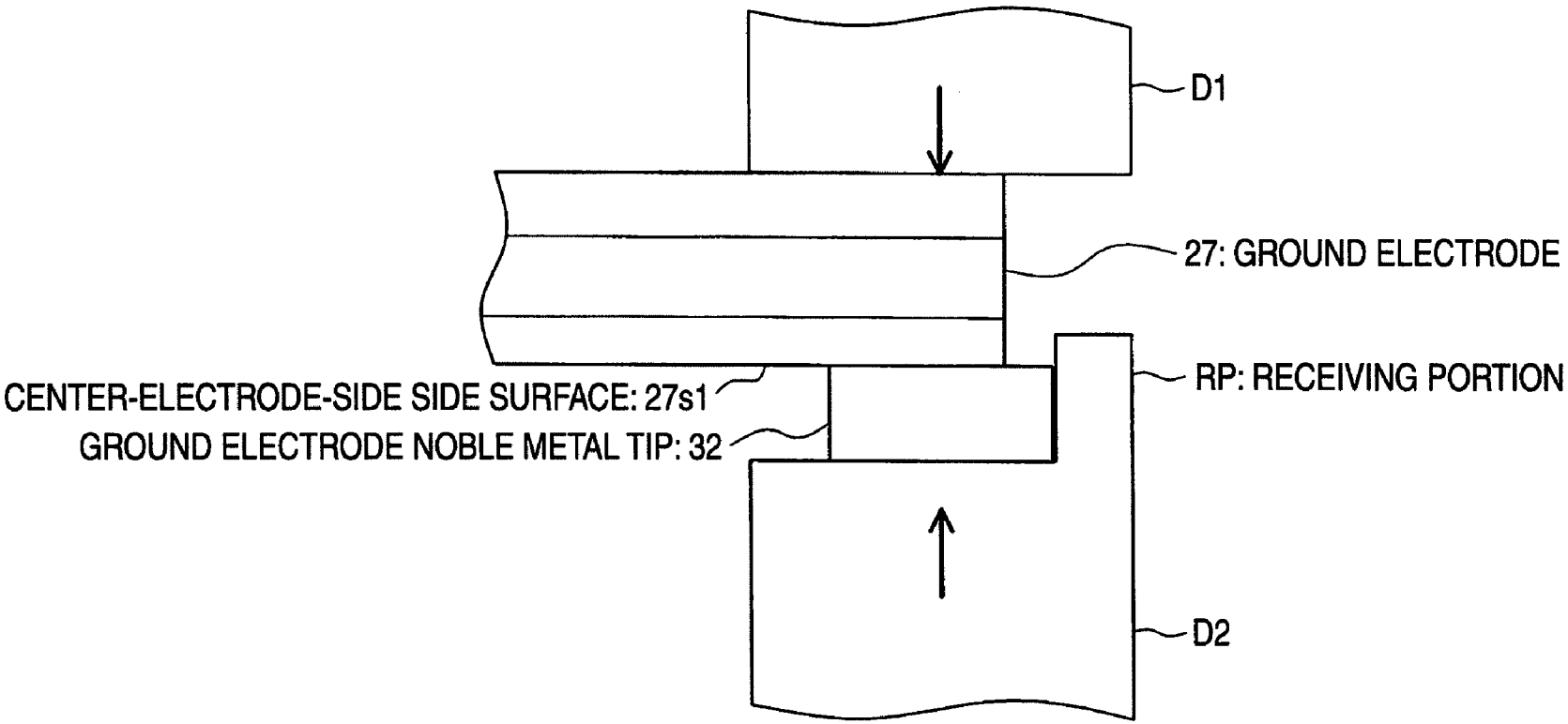
FIG. 7 is a partially-enlarged schematic view for describing a junction between the ground electrode and the ground electrode noble metal tip in the embodiment.
Figure 8:
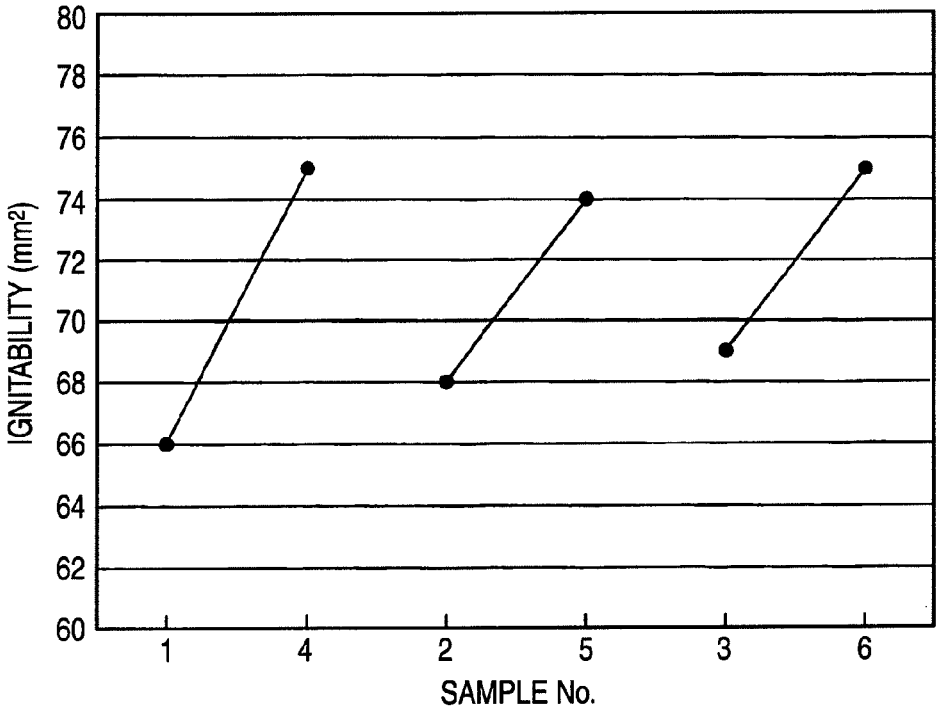
FIG. 8 is a graph showing results of an ignitability evaluation test of samples differing from each other in terms of presence/absence of chamfered portions.
Figure 9:
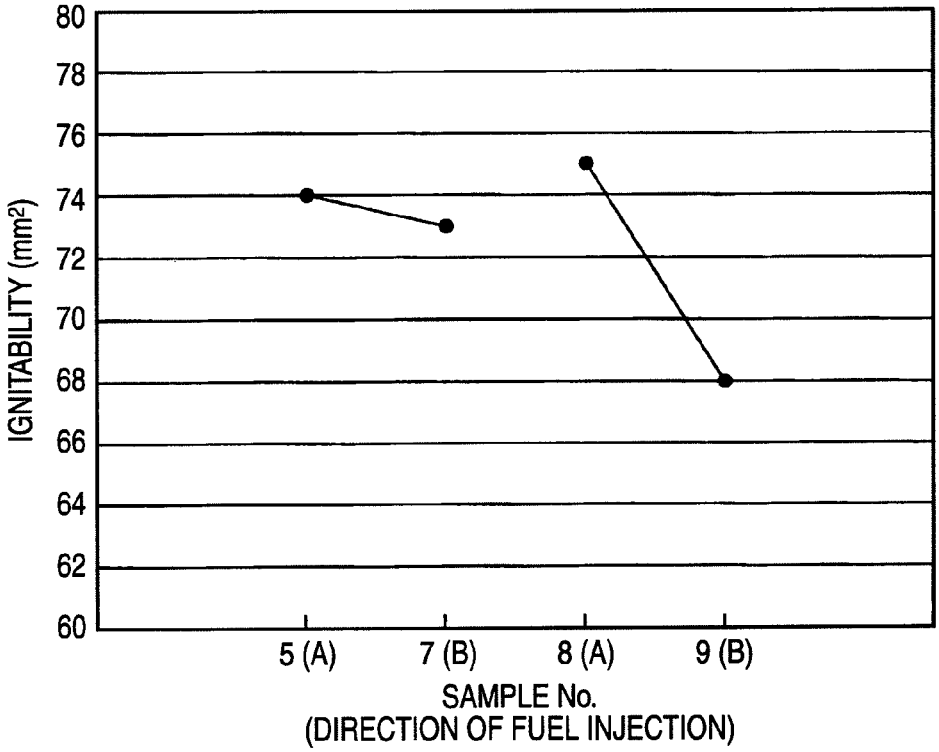
FIG. 9 is a graph showing results of the ignitability evaluation test of samples differing from each other in terms of presence/absence of back-side chamfered portions.
Figure 10:
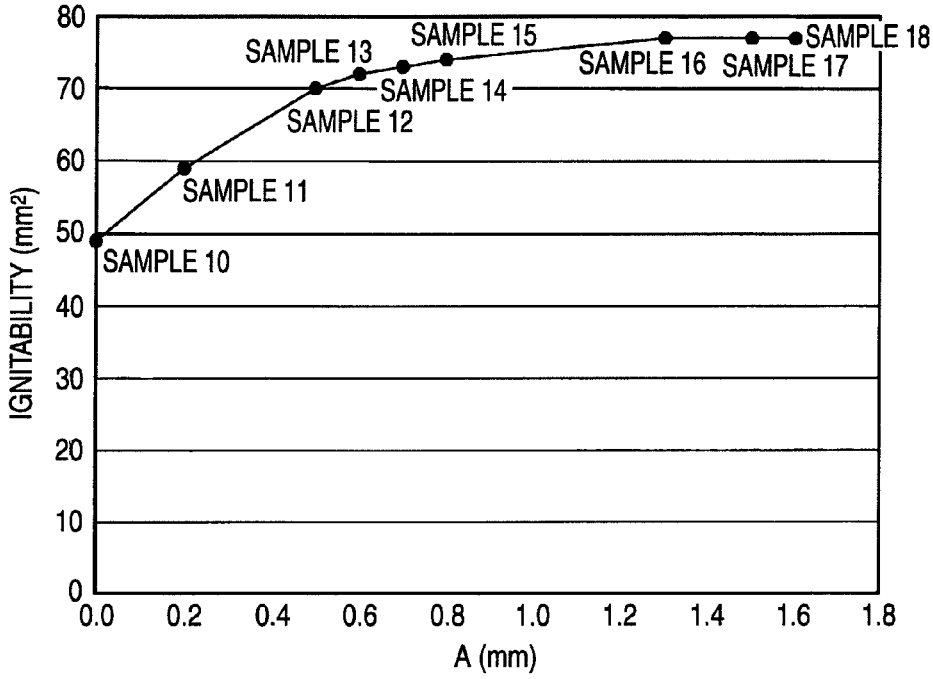
FIG. 10 is a graph showing results of the ignitability evaluation test of samples differing from each other in terms of a tip distal end projection length.
Figure 11:
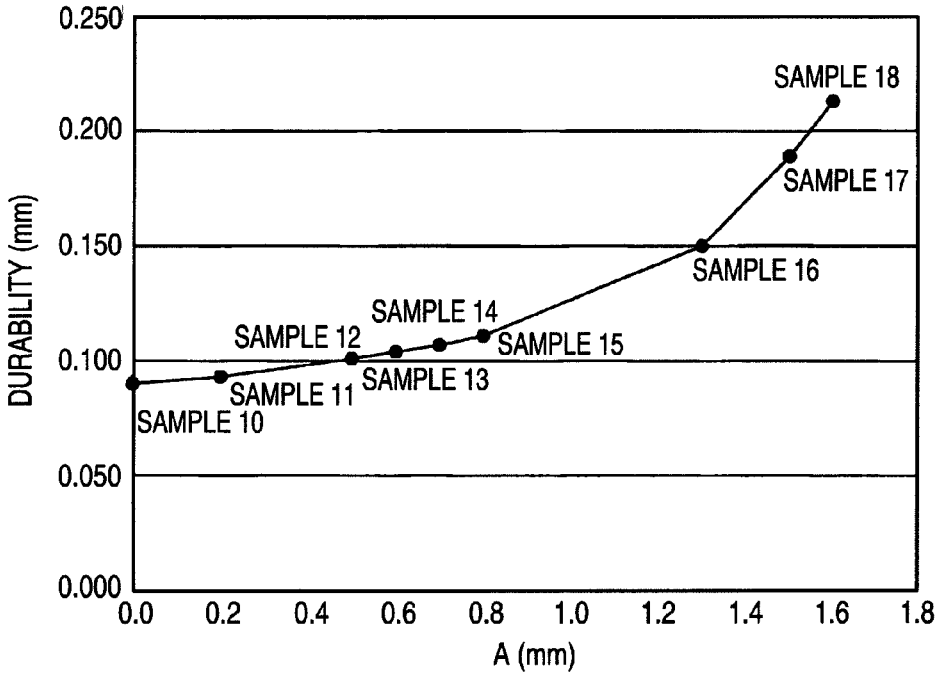
FIG. 11 is a graph showing results of a durability evaluation test of the samples differing from each other in terms of the tip distal end projection length.
Figure 12:
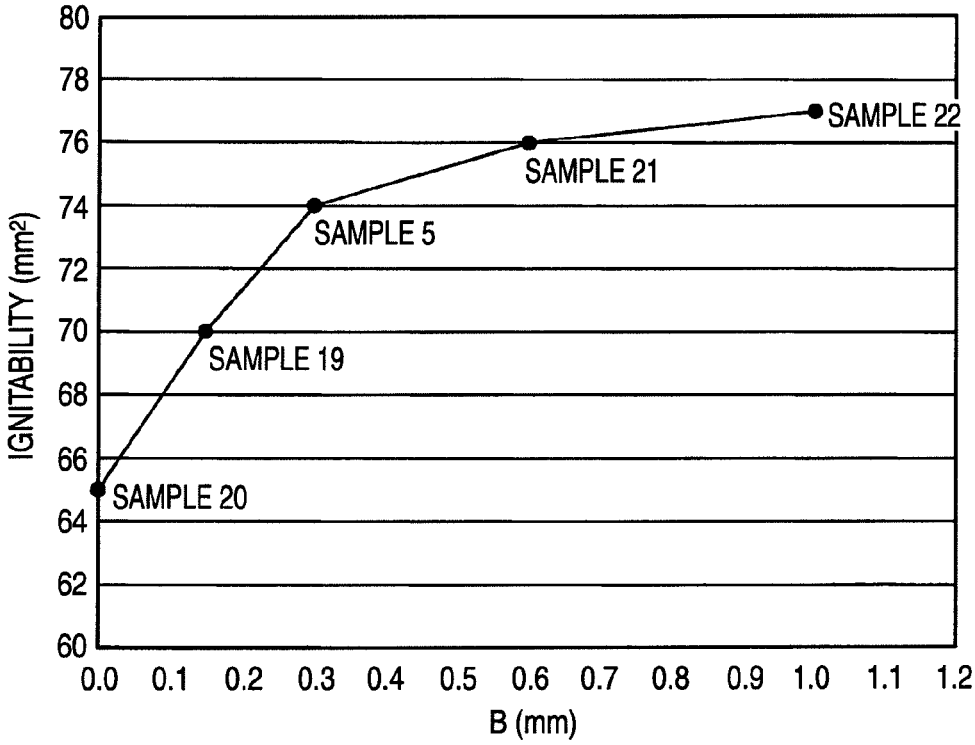
FIG. 12 is a graph showing results of an ignitability evaluation test of samples differing from each other in terms of a tip side surface projection length.
Figure 13:
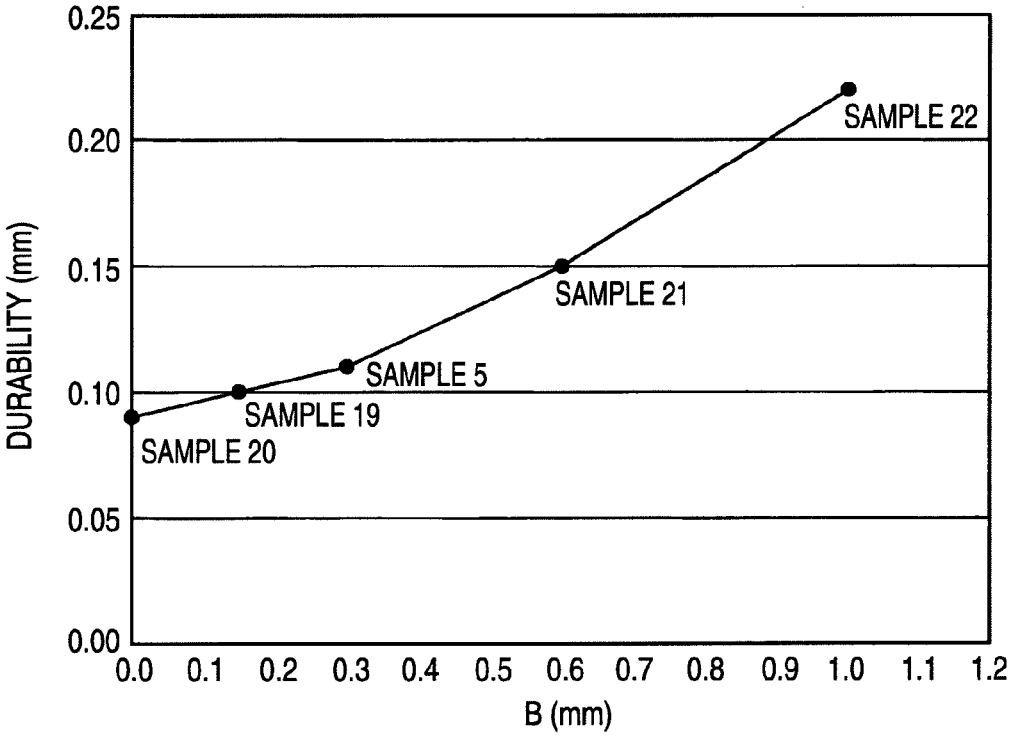
FIG. 13 is a graph showing results of a durability evaluation test of the samples differing from each other in terms of the tip side surface projection length.
Figure 14:
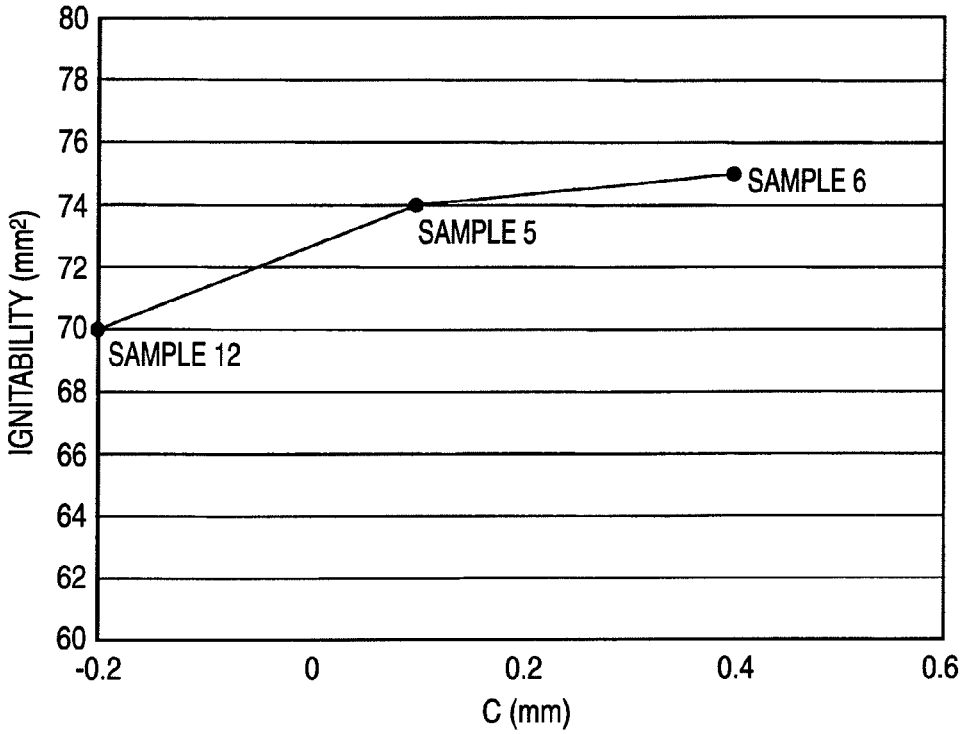
FIG. 14 is a graph showing results of an ignitability evaluation test of samples differing from each other in terms of an inter-electrode distance.
Figure 15:
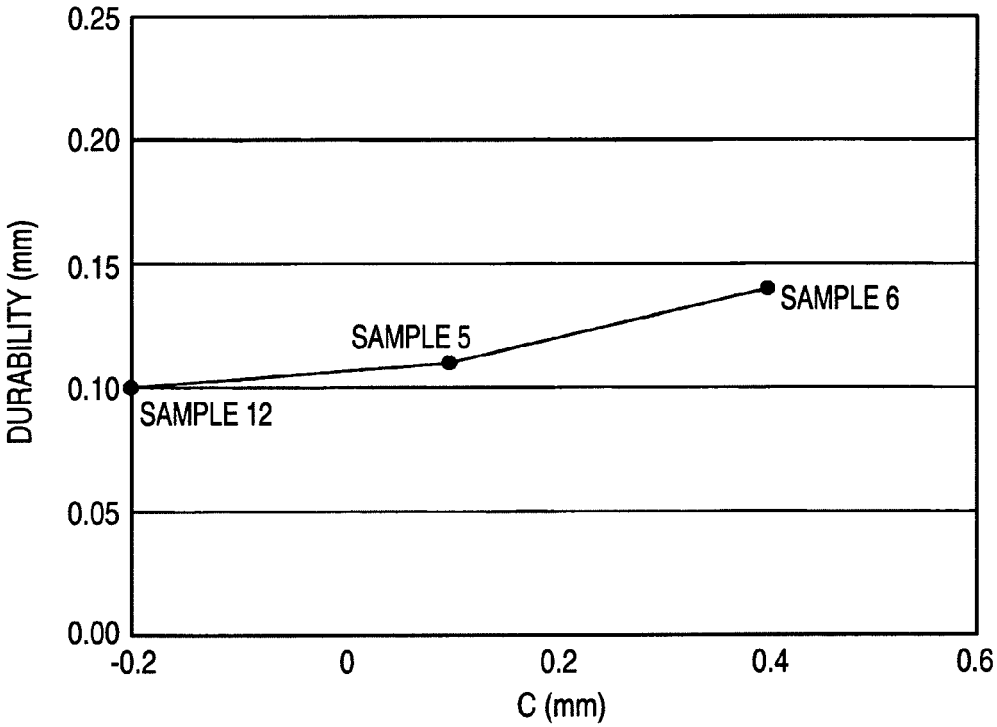
FIG. 15 is a graph showing results of a durability evaluation test of the samples differing from each other in terms of the inter-electrode distance.
Figure 16:
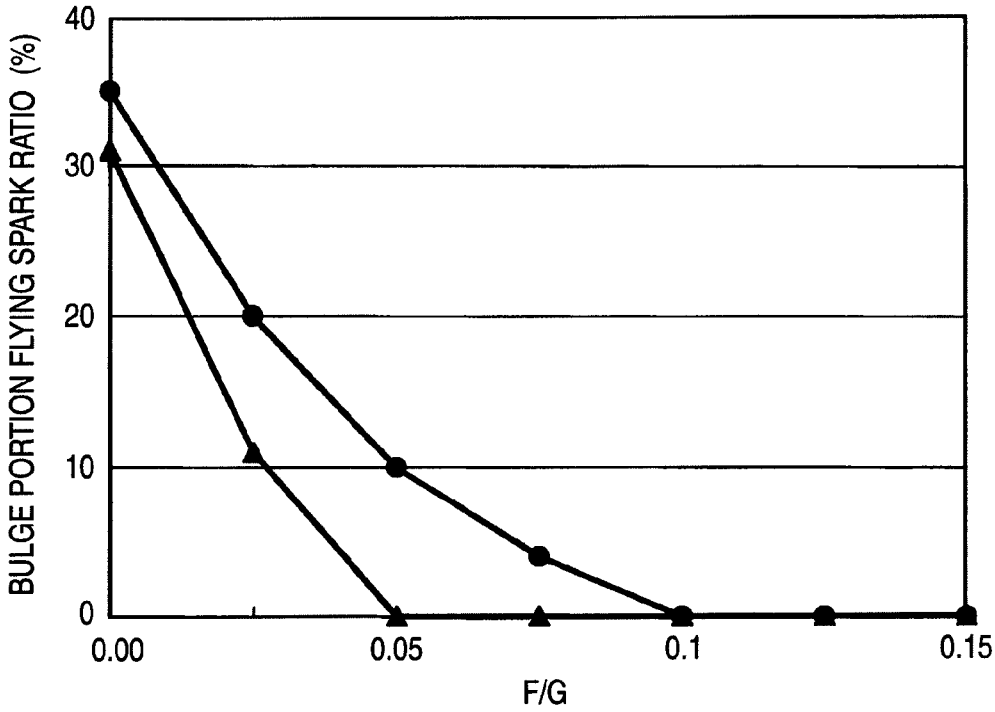
FIG. 16 is a graph showing a relationship between an F/G and a bulge portion flying spark ratio.
Figure 17:
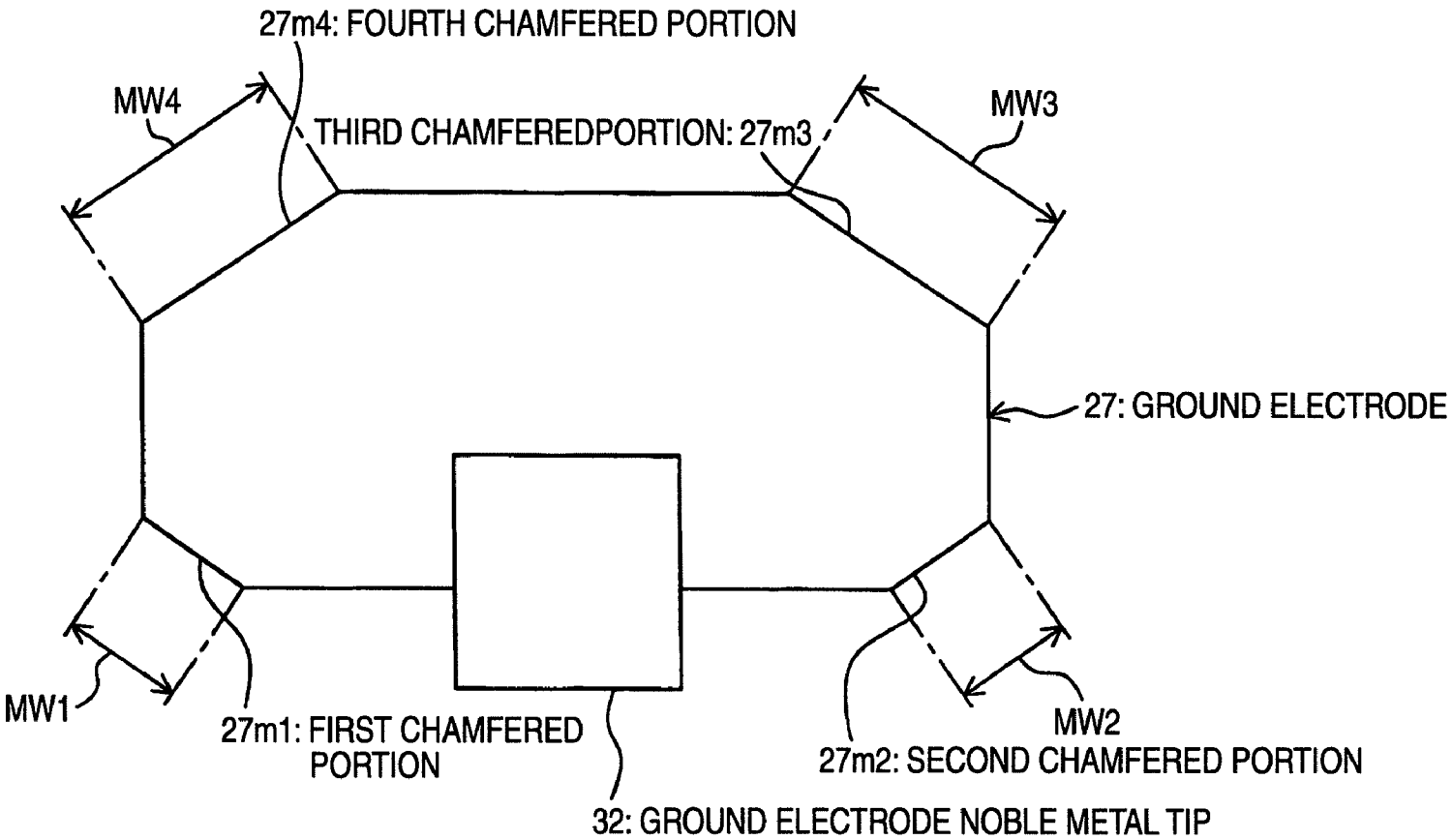
FIG. 17 is a partially-enlarged side view of a distal end of the ground electrode for describing the widths of chamfered portions of another embodiment.
Figure 18:
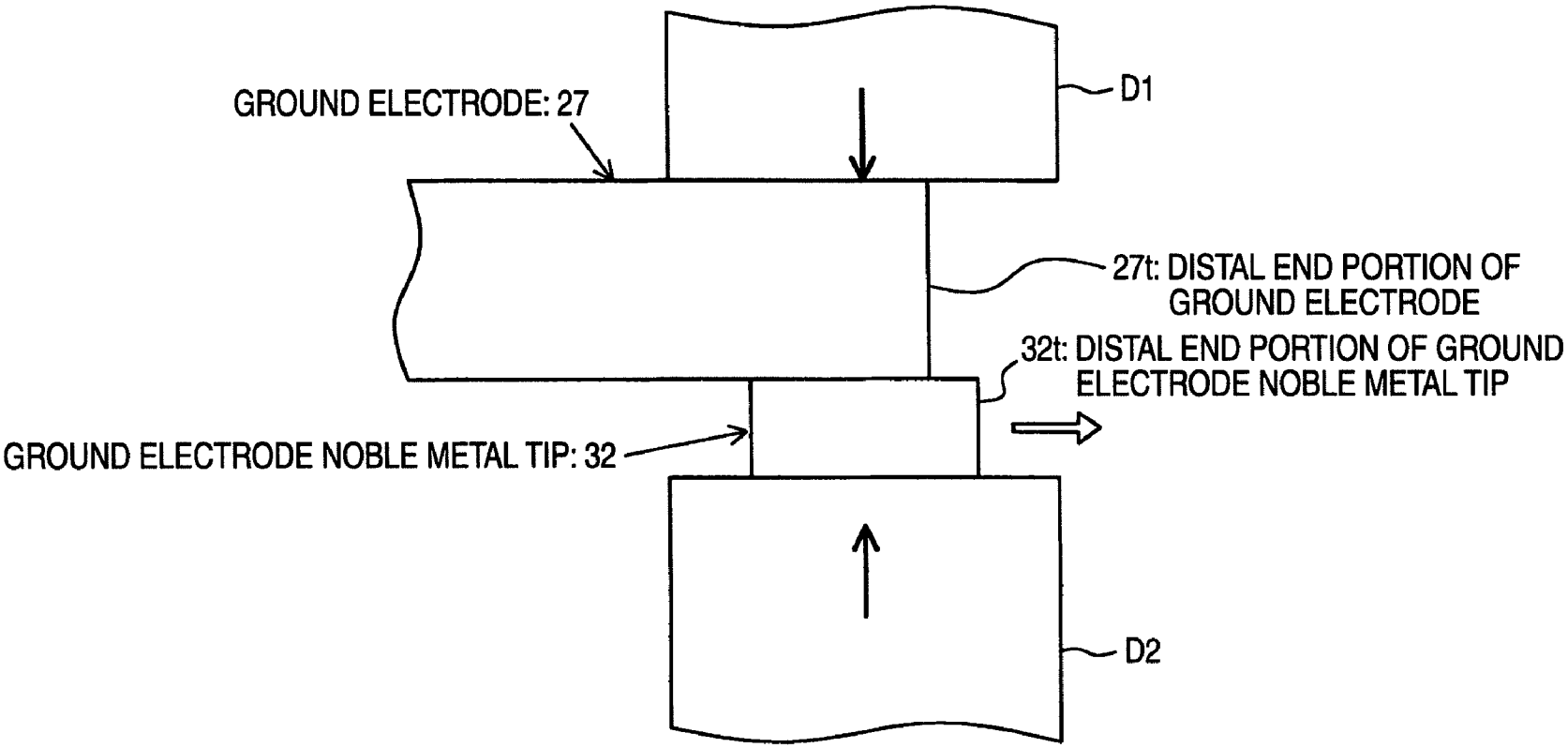
FIG. 18 is a partially-enlarged schematic view for describing a junction between a ground electrode and a ground electrode noble metal tip in the related art.

1 . . . spark plug for internal combustion engine
2 . . . insulator serving as insulating body
3 . . . metal shell
4 . . . axial hole
5 . . . center electrode
26 . . . leading end portion of metal shell
27 . . . ground electrode
**27*m*1** . . . first chamfered portion
**27*m*2** . . . second chamfered portion
**27*m*3** . . . third chamfered portion
**27*m*4** . . . fourth chamfered portion
**27*r*1, 27*r*2** . . . curved surface portion
**27*s*1** . . . center-electrode-side side surface
**27*s*2** . . . back-side side surface
**27*s*3, 27*s*4** . . . side surface
**27*t*** . . . distal end portion of ground electrode
31 . . . ground electrode noble metal tip
**31*g*** . . . outer periphery of ground electrode noble metal tip
32 . . . ground electrode noble metal tip
**32*t*** . . . distal end portion of ground electrode noble metal tip
33 . . . spark discharge gap serving as gap
41 . . . bulge portion
a1, a2, c1, c2 . . . thicknesswise length of chamfered portion
b1, b2, d1, d2 . . . widthwise length of chamfered portion
a . . . tip distal end projection length
b . . . tip side projection length
c . . . inter-electrode distance
cl1 . . . axial line
cl2 . . . center line of ground electrode
rp . . . receiving portion serving as relative movement regulation means
VG . . . imaginary outer peripheral line

The invention claimed is:

1. A spark plug for an internal combustion engine comprising:

a rod-shaped center electrode extending in a direction of an axial line;

a substantially-cylindrical insulator provided around an outer periphery of the center electrode;

a substantially-cylindrical metal shell provided around an outer periphery of the insulator;

a ground electrode arranged to extend from a leading end portion of the metal shell such that a distal end of the ground electrode is bent toward the center electrode;

a center electrode noble metal tip joined to a leading end of the center electrode; and a ground electrode noble metal tip joined to a distal end side of a center-electrode-side side surface portion, of side surface portions of the ground electrode, located on a center electrode side, a distal end portion of the ground electrode noble metal tip projecting from a distal end portion of the ground electrode toward the axial line, and a side surface portion on a center electrode side of the ground electrode noble metal tip projecting from the center-electrode-side side surface portion of the ground electrode, wherein a gap is provided between the center electrode noble metal tip and the ground electrode noble metal tip, and the ground electrode noble metal tip overlaps in plan view the center electrode noble metal tip along the direction of the axial line, wherein a tip distal end projection length that is a shortest distance from the distal end portion of the ground electrode to the distal end portion of the ground electrode noble metal tip is 0.5 mm to 1.5 mm, wherein a tip side surface projection length that is a shortest distance from the center-electrode-side side surface portion of the ground electrode to the side surface portion on the center electrode side of the ground electrode noble metal tip is not less than 0.15 mm but not more than 0.6 mm;

wherein the ground electrode has a back-side side surface portion situated on back of the center-electrode-side side surface portion, and a side surface portion situated between the center-electrode-side side surface portion and the back-side side surface portion, and at least one of a chamfered portion and a curved surface portion formed between adjacent side surface portions of the respective side surface portions, wherein, in a cross section perpendicular to a center axis of the ground electrode, a thicknesswise length of the chamfered portion along a thickness direction of the ground electrode is 0.2 mm or more, and a widthwise length of the chamfered portion along a widthwise direction of the ground electrode is 0.2 mm or more, and a curvature radius of the curved surface portion in the cross section perpendicular to the center axis of the ground electrode is 0.2 mm or more.

2. The spark plug for an internal combustion engine according to claim 1, wherein the tip side surface projection length is 0.3 mm or more.

3. The spark plug for an internal combustion engine according to claim 1, wherein the tip distal end projection length is 1 mm or more.

4. The spark plug for an internal combustion engine according to claim 1, wherein a bulge portion containing a same metallic material as that of the ground electrode is formed so as to cover at least a portion, which is located along a direction of the center axis of the ground electrode, of a boundary portion between the ground electrode noble metal tip and the center-electrode-side side surface portion of the ground electrode, wherein an inter-electrode distance that is a shortest distance between the distal end portion of the ground electrode and the imaginary outer periphery is −0.1 mm or more where, with reference to the distal end portion of the ground electrode when viewed from a leading-end side in the direction of the axial line, a direction toward a base side of the ground electrode is a negative direction and a direction away from the base side of the ground electrode is a positive direction, and wherein $F \geqq 0.1G$ is satisfied where, in a direction in which the side surface portion on the center electrode side of the ground electrode noble metal tip protrudes with respect to the center-electrode-side side surface portion of the ground electrode, F is a shortest distance between the bulge portion and the side surface portion on the center electrode side of the ground electrode noble metal tip and G is a shortest distance of the gap.

5. The spark plug for an internal combustion engine according to claim 1, wherein an inter-electrode distance that is a shortest distance between the distal end portion of the ground electrode and the imaginary outer periphery is +0.1 mm to +0.8 mm where, with reference to the distal end portion of the ground electrode when viewed from a leading-end side in the direction of the axial line, a direction toward a base side of the ground electrode is a negative direction and a direction away from the base side of the ground electrode is a positive direction.

6. The spark plug for an internal combustion engine according to claim 5, wherein a bulge portion containing a same metallic material as that of the ground electrode is formed so as to cover at least a portion, which is located along a direction of the center axis of the ground electrode, of a boundary portion between the ground electrode noble metal tip and the center-electrode-side side surface portion of the ground electrode, and wherein $F \geqq 0.05G$ is satisfied where, in a direction in which the side surface portion on the center electrode side of the ground electrode noble metal tip protrudes with respect to the center-electrode-side side surface portion of the ground electrode, F is a shortest distance between the bulge portion and the side surface portion on the center electrode side of the ground electrode noble metal tip and G is a shortest distance of the gap.

7. The spark plug for an internal combustion engine according to claim 5, wherein a width of a gap-side chamfered portion or a gap-side curved surface portion as the chamfered portion or the curved surface portion which is formed between the center-electrode-side side surface portion and the side surface portion adjacent to the center-electrode-side side surface portion is smaller than a width of a back-side chamfered portion or a back-side curved surface portion as the chamfered portion or the curved surface portion which is formed between the back-side side surface portion and the side surface portion adjacent to the back-side side surface portion.

8. The spark plug for an internal combustion engine according to claim 1, wherein the ground electrode noble metal tip has a prismatic shape.

9. The spark plug for an internal combustion engine according to claim 1, wherein the ground electrode noble metal tip contains platinum as a main component and also contains one of nickel in an amount of 2 mass % to 30 mass %, iridium in an amount of 3 mass % to 40 mass %, and rhodium in an amount of 3 mass % to 45 mass %.

10. The spark plug for an internal combustion engine according to claim 1, wherein a bulge portion containing a same metallic material as that of the ground electrode is formed so as to cover at least a portion, which is located along a direction of the center axis of the ground electrode, of a boundary portion between the ground electrode noble metal tip and the center-electrode-side side surface portion of the ground electrode, and wherein a height of the bulge portion with reference to the center-electrode-side side surface portion of the ground electrode is 0.1 mm or more.

11. The spark plug for an internal combustion engine according to claim 1, wherein a bulge portion containing a same metallic material as that of the ground electrode is formed so as to cover a boundary portion extending along a direction of the center axis of the ground electrode between the ground electrode noble metal tip and the center-electrode-side side surface portion of the ground electrode, and wherein a shortest distance, along the widthwise direction of the center-electrode-side side surface portion, between the bulge portion and the chamfered portion or the curved surface portion formed between the center-electrode-side side surface portion and the side surface portion adjacent to the center-electrode-side side surface portion is set to 0.2 mm or more.

12. A method for manufacturing the spark plug for an internal combustion engine according to claim 1, the method comprising:

a joining process comprising joining the ground electrode to the ground electrode noble metal tip by resistance welding, wherein relative movement regulation means for regulating relative movement of the ground electrode noble metal tip with respect to the ground electrode toward a distal end side of the ground electrode is used in the joining process.

* * * * *